US005958638A

United States Patent [19]

Katayama et al.

[11] Patent Number: 5,958,638

[45] Date of Patent: Sep. 28, 1999

[54] ELECTROPHOTOGRAPHIC PHOTOCONDUCTOR AND METHOD OF PRODUCING SAME

[75] Inventors: Satoshi Katayama, Nabari; Takahiro Teramoto, Tenri; Kiyofumi Morimoto, Yamatokoriyama; Satoshi Machino, Joyo; Tatsuhiro Morita, Kashiba; Tomoko Kanazawa, Kashihara, all of Japan

[73] Assignee: Sharp Kabushiki Kaisha, Japan

[21] Appl. No.: 09/099,039

[22] Filed: Jun. 18, 1998

[30] Foreign Application Priority Data

Jun. 23, 1997 [JP] Japan ..... 9-166286

[51] Int. Cl.[6] ..... G03G 5/14

[52] U.S. Cl. ..... 430/65; 430/131

[58] Field of Search ..... 430/65, 131

[56] References Cited

U.S. PATENT DOCUMENTS

| | | | |
|---|---|---|---|
| 4,518,669 | 5/1985 | Yahiki | 430/57 |
| 5,391,448 | 2/1995 | Katayama et al. | 430/65 |
| 5,401,600 | 3/1995 | Aizawa et al. | 430/65 |
| 5,464,718 | 11/1995 | Kashizaki et al. | 430/58 |
| 5,489,496 | 2/1996 | Katayama et al. | 430/131 |
| 5,677,094 | 10/1997 | Umeda et al. | 430/58 |
| 5,744,271 | 4/1998 | Aizawa et al. | 430/65 |

FOREIGN PATENT DOCUMENTS

| | | |
|---|---|---|
| 0 785 477 | 7/1977 | European Pat. Off. . |
| 0 718 699 | 6/1996 | European Pat. Off. . |
| 48-47344 | 7/1973 | Japan . |
| 52-25638 | 2/1977 | Japan . |
| 55-25030 | 2/1980 | Japan . |
| 56-52757 | 5/1981 | Japan . |
| 59-93453 | 5/1984 | Japan . |
| 63-234261 | 9/1988 | Japan . |
| 63-298251 | 12/1988 | Japan . |
| 2-181158 | 7/1990 | Japan . |
| 4-172362 | 6/1992 | Japan . |
| 4-229872 | 8/1992 | Japan . |

OTHER PUBLICATIONS

Database WPI Section Ch, Week 9438, Derwent Publications Ltd., London, GB; Class A89, AN 94–308114, XP002078055 & JP 06 236061 A (Fuji Xerox Co Ltd), Aug. 23, 1994.

Database WPI, Section Ch, Week 9438, Derwent Publications Ltd., London, GB; Class A89, AN 94–308115 XP002078056 & JP 06 236062 A (Fuji Xerox Co Ltd), Aug. 23, 1994.

Database WPI, Section Ch, Week 9724, Derwent Publications Ltd., London GB; Class A89, AN 97–268776 XP002078076 & JP 09 096916 A (Sharp KK), Apr. 8, 1997.

Database WPI, Section Ch, Week 9832, Derwent Publications Ltd., London, GB; Class A89, AN 98–372286 XP002078057 & JP 10 148959 A (Sharp KK), Jun. 2, 1998.

*Primary Examiner*—Roland Martin

*Attorney, Agent, or Firm*—Nixon & Vanderhye

[57] ABSTRACT

An object of the invention is to provide an electrophotographic photoconductor featuring uniform chargeability to a predetermined potential, low residual potential and excellent stability in the operating environment and repeated use thereof, as well as a method of producing the same. An undercoat layer between a substrate and a photosensitive layer is formed by the use of a coating fluid for undercoat layer containing a coupling agent having an unsaturated bond, a metal oxide, a binder and a mixture solvent. The coupling agent increases affinity of the metal oxide for the binder so that the coating fluid does not suffer the aggregation of the metal oxide or gelation thereof, presenting homogeneity and excellent can-stability. Thus is obtained a uniform undercoat layer. A photoconductor having this undercoat layer is adapted to be uniformly charged to a predetermined potential and to suppress the rise of residual potential and particularly the rise of residual potential due to a use thereof under low-temperature, low-humidity conditions or the repeated use thereof over an extended period of time, thus offering a high photosensitivity in a stable manner.

13 Claims, 2 Drawing Sheets

ELECTROPHOTOGRAPHIC PHOTOCONDUCTOR AND METHOD OF PRODUCING SAME

BACKGROUND OF THE INVENTION

1. Field of the Invention

The present invention relates to an electrophotographic photoconductor having an undercoat layer between a substrate and a photosensitive layer and a method of producing the same, and particularly, to the undercoat layer and a method of forming the same.

2. Description of the Related Art

The electrophotographic image forming process utilizing a photoconductor having photoconductivity, in general, is one of the image recording methods utilizing a photoconduction phenomenon of the photoconductor. More specifically, an image is formed by the steps of first uniformly charging the surface of the photoconductor by means of corona discharge in darkness, subsequently irradiating the charged surface of the photoconductor with an image light thereby selectively dissipating the charge of a light exposed portion of the photoconductor for forming an electrostatic latent image in an unexposed portion thereof, and developing the electrostatic latent image into a visible image by making toner particles, which are colored and charged, adhere to the electrostatic latent image by means of an electrostatic attractive force or the like.

In the sequence of the image forming process, the photoconductor is required of basic properties which include uniform chargeability to a predetermined potential in darkness, excellent charge-preservability for lower discharge, high photosensitivity such as to quickly start discharging in response to the light irradiation and the like. The photoconductor is further required of easy elimination of static charge on the surface thereof, and low residual potential and high mechanical strength of the surface thereof. In addition, the photoconductor must also present good flexibility, small variations in the electric properties including chargeability, photosensitivity and residual potential despite repeated use thereof, and good resistance to heat, light, temperature, moisture and ozone degradation.

The photoconductors currently used and giving considerations to the aforementioned properties are constructed such that the photosensitive layer is formed on the substrate having photoconductivity. Unfortunately, however, the aforesaid photoconductor is susceptible to carrier injection from the substrate into the photosensitive layer such that the charge on the surface of the photoconductor may be microscopically dissipated or decayed. This will result in the production of a defective image. There has been suggested a photoconductor wherein the undercoat layer is interposed between the substrate and the photosensitive layer in order to solve such a problem, cover a surface flaw of the substrate, improve the chargeability of the photoconductor and enhance adhering and coating properties of the photosensitive layer with respect to the substrate.

In the prior-art undercoat layer composed of a resin material alone, examples of a usable resin material include polyethylene, polypropylene, polystyrene, acrylic resin, vinyl chloride resin, vinyl acetate resin, polyurethane, epoxy resin, polyester, melamine resin, silicone resin, polyvinyl butyral, polyamide, and copolymers containing two or more of repeated units of these resins. The usable resin materials further include casein, gelatin, polyvinyl alcohol, ethyl cellulose and the like. Japanese Unexamined Patent Publication JP-A 48-47344(1973) discloses polyamide as a preferred resin material whereas Japanese Unexamined Patent Publication JP-A 52-25638(1977) discloses polyamide soluble in a solvent of halogenated hydrocarbon or alcohol as the preferred resin material.

The aforementioned photoconductor including the undercoat layer composed of the resin material alone suffers a relatively high residual potential and hence, a reduced photosensitivity. Therefore, the toner particles tend to adhere to a non-image area which does not bear the electrostatic latent image, thus resulting in the production of a defective image called a fogged image. Such a phenomenon is particularly frequently observed under conditions of low temperatures and low humidities. For elimination of such a phenomenon, the utilization of an undercoat layer composed of conductive particles or a resin material containing the conductive particles has been disclosed in, for example, Japanese Unexamined Patent Publications JP-A 55-25030 (1980), JP-A 56-52757(1981), JP-A 59-93453(1984), JP-A 63-234261(1988), JP-A 63-298251(1988), JP-A 2-181158 (1990), JP-A 4-172362(1992), and JP-A 4-229872(1992).

The aforesaid Japanese Unexamined Patent Publication JP-A 55-25030(1980) has disclosed an undercoat layer composed of conductive particles embodied by a metal such as Ag, Cu, Ni, Au, Bi or carbon, as well as an undercoat layer composed of a binder having the conductive particles dispersed therein. The Japanese Unexamined Patent Publication JP-A 56-52757(1981) has disclosed an undercoat layer containing titanium oxide.

The Japanese Unexamined Patent Publication JP-A 59-93453(1984) has disclosed an undercoat layer containing particulate titanium oxide surface-treated with tin oxide or alumina. The Japanese Unexamined Patent Publication JP-A 2-181158(1990) has disclosed an undercoat layer composed of a polyamide resin wherein particles of titanium oxide coated with alumina are dispersed. The Japanese Unexamined Patent Publication JP-A 4-172362(1992) has disclosed an undercoat layer containing a binder and particles of metal oxide, such as titanium oxide and tin oxide, which particles are surface-treated with a titanate coupling agent. The Japanese Unexamined Patent Publication JP-A 4-229872(1992) has disclosed an undercoat layer containing a binder and particles of metal oxide surface-treated with a silane compound or a fluorine-containing silane compound.

In the Japanese Unexamined Patent Publications JP-A 63-234261(1988) and JP-A 63-298251(1988), there are disclosed optimum mixing ratios between a white pigment and a binder in an undercoat layer principally composed of the white pigment, such as titanium oxide, and the binder.

The aforementioned undercoat layers and photosensitive layers are formed by a dip coating method featuring a relatively easy coating process, high productivity and low production cost. Since the forming of the undercoat layer is followed by the forming of the photosensitive layer, a resin material for the undercoat layer is preferably insoluble in a solvent for a coating fluid for photosensitive layer. In the light of the foregoing, a coating fluid for undercoat layer generally employs a resin material soluble in alcohol or water. The coating fluid is prepared by dissolving or dispersing the resin material therein.

In the case of the undercoat layer containing metal particles as the conductive particles, there is a problem that the photoconductor has a lowered chargeability which leads to a reduced image density when the photoconductor is repeatedly used.

In the case of the undercoat layer containing particles of metal oxide such as titanium oxide, an undercoat layer, which contains titanium oxide in a smaller amount and a binder in a correspondingly larger amount, has a great volume resistance, thus suppressing the transfer of carriers produced during the light irradiation. This leads to an increased residual potential of the photoconductor and hence, a defective image such as a fogged image results. Additionally, the photoconductor cannot offer satisfactory imaging characteristics because of serious decrease in the durability under conditions of low temperatures and low humidity.

Increasing the amount of titanium oxide may contribute to a smaller increase of the residual potential and to a smaller decrease of the durability under the low-temperature, low-humidity conditions. However, as repeatedly used over an extended period of time, the photoconductor tends to suffer an increased residual potential, particularly under the low-temperature, low-humidity conditions. As a result, the photoconductor cannot continue to maintain stable properties thereof over an extended period of time. On the other hand, the undercoat layer containing the binder in very little amount is decreased in the film strength and the adhesion to the substrate. This leads to a separation of the photosensitive layer and hence, the defective image results. In addition, because of serious decrease in the volume resistance, the photoconductor is lowered in the chargeability. Furthermore, titanium oxide presents a smaller affinity for the binder so that the dispersibility and can-stability of the coating fluid for undercoat layer is decreased. This results in inconsistent coating thicknesses and hence, excellent imaging characteristics of the photoconductor are not obtained.

SUMMARY OF THE INVENTION

It is therefore, an object of the invention to provide an electrophotographic photoconductor and a method of producing the same, the photoconductor adapted to be uniformly charged to a predetermined charge and to present a lower residual potential and excellent stability in the operating environment as well as in repeated use thereof.

The invention provides an electrophotographic photoconductor comprising:

a conductive substrate;

an undercoat layer formed on the substrate; and a photosensitive layer formed on the undercoat layer, wherein the undercoat layer includes a coupling agent having an unsaturated bond, a metal oxide and a binder.

In accordance with the invention, the undercoat layer interposed between the substrate and the photosensitive layer includes the coupling agent having the unsaturated bond, the metal oxide and the binder. By virtue of the coupling agent with the unsaturated bond contained in the undercoat layer, the metal oxide is increased in the affinity for the binder so that, despite a great content of the metal oxide, the metal oxide is uniformly dispersed in a coating fluid for undercoat layer without producing the aggregation thereof or causing the gelation of the coating fluid. This also leads to increased can-stability of the coating fluid. Consequently, there is formed the undercoat layer of consistent thickness. Therefore, the resultant photoconductor can be uniformly charged to a predetermined charge. Because of an increased content of the metal oxide, the undercoat layer has a relatively small volume resistance, thus ensuring the transfer of produced carriers. Accordingly, the rise of residual potential is suppressed. Furthermore, there is prevented the rise of residual potential due to the operating environment, particularly under the low-temperature, low-humidity conditions or due to repeated use of the photoconductor over an extended period of time. As a result, the photoconductor can offer a high photosensitivity in a stable manner.

The photoconductor of the invention is characterized in that the coupling agent is a sililation agent having an unsaturated bond.

In accordance with the invention, the use of the sililation agent with the unsaturated bond as the coupling agent provides the undercoat layer featuring the aforementioned effects.

The photoconductor of the invention is further characterized in that the coupling agent is a silane coupling agent having an unsaturated bond.

In accordance with the invention, the use of the silane coupling agent with the unsaturated bond as the coupling agent also provides the undercoat layer featuring the aforementioned effects.

The photoconductor of the invention is further characterized in that the metal oxide is preliminarily surface-treated with the coupling agent.

In accordance with the invention, by subjecting the metal oxide to the preliminary surface treatment with the coupling agent, a coating fluid for undercoat layer resistant to the aggregation of the metal oxide and the gelation of the fluid can be prepared using a small amount of coupling agent. Furthermore, such a surface treatment contributes to an improved dispersibility and can-stability of the coating fluid for undercoat layer. Consequently, there may be formed the undercoat layer of consistent thickness. In addition, the production costs for the undercoat layer may be decreased.

The photoconductor of the invention is further characterized in that the metal oxide is titanium oxide having a needle-like particulate shape.

In accordance with the invention, the use of the needle-shaped particles of titanium oxide as the metal oxide offers a relatively increased chance that the needle-shaped particles of titanium oxide come into contact with one another. Hence, despite a relatively small content of titanium oxide, the rise of residual potential due to the operating environment, particularly under the low-temperature, low-humidity conditions, may be suppressed. Since the content of titanium oxide can be decreased, the undercoat layer is improved in the film strength and the adhesion to the substrate. This also allows the electrophotographic photoconductor to achieve an excellent stability because the photoconductor is less susceptible to the degradation of the electrical properties and imaging characteristics thereof due to the repeated use thereof over an extended period of time. In a comparison between an undercoat layer containing granules of metal oxide and that containing needle-shaped particles of metal oxide, both undercoat layers containing the metal oxide in the same content, the undercoat layer containing the needle-shaped particles of metal oxide presents a lower resistance, thus allowing for increase in the thickness of the undercoat layer. Accordingly, the surface of the undercoat layer does not reflect a surface flaw of the substrate and hence, the undercoat layer may accomplish a good surface smoothness.

The photoconductor of the invention is further characterized in that the metal oxide has a needle-like particulate shape having a short axis selected from a range of between 0.001 $\mu$m and 1 $\mu$m, a long axis selected from a range of between 0.002 $\mu$m and 100 $\mu$m, and a mean value of an aspect ratio selected from a range of between 1.5 and 300.

In accordance with the invention, the undercoat layer featuring the aforementioned effects can be embodied by using the needle-shaped particles of metal oxide which have the short axis selected from the range of between 0.001 μm and 1 μm, the long axis selected from the range of between 0.002 μm and 100 μm, and the mean value of the aspect ratios selected from the range of between 1.5 and 300.

The photoconductor of the invention is further characterized in that a proportion of the metal oxide relative to the total weight of the undercoat layer is selected from a range of between 10 wt % and 99 wt %.

In accordance with the invention, the rise of residual potential due to the operating environment, particularly under the low-temperature, low-humidity conditions is suppressed by selecting the proportion of the metal oxide relative to the total weight of the undercoat layer from the aforesaid range and thus, the photoconductor can achieve a high photosensitivity in a stable manner.

The photoconductor of the invention is further characterized in that the binder comprises a polyamide resin soluble in an organic solvent.

In accordance with the invention, the use of the polyamide resin soluble in the organic solvent as the binder contributes to a better affinity of the metal oxide for the binder and an excellent adhesion of the binder to the substrate. In addition, the undercoat layer is allowed to have a good flexibility. The polyamide resin does not swell or dissolve in solvents generally used for the coating fluid for photosensitive layer and therefore, the occurrence of coating flaws or inconsistent coating thicknesses can be prevented in the process of forming the undercoat layer. As a result, the undercoat layer of consistent thickness may be formed.

The photoconductor of the invention is further characterized in that the metal oxide is titanium oxide not subject to a surface-treatment for conductivity impartation.

In accordance with the invention, by using, as the aforesaid metal oxide, titanium oxide which is not subject to the surface treatment for conductivity impartation, the undercoat layer is allowed to serve as a charge blocking layer for suppressing the charge injection from the substrate. Thus, the photoconductor is prevented from being reduced in the chargeability due to the repeated use thereof.

The invention further provides a method of producing an electrophotographic photoconductor, which includes a conductive substrate, an undercoat layer formed on the substrate and a photosensitive layer formed on the undercoat layer, wherein the undercoat layer is formed by the use of a coating fluid for undercoat layer which contains a coupling agent having an unsaturated bond, a metal oxide, a binder and a solvent.

In accordance with the invention, the undercoat layer is formed by using the coating fluid for undercoat layer which includes the coupling agent with the unsaturated bond, the metal oxide, the binder and the solvent. The coating fluid for undercoat layer features a high dispersibility of the metal oxide and homogeneity. That is, when the substrate is dipped in the coating fluid for undercoat layer for forming the undercoat layer, for example, the occurrence of coating flaws or inconsistent coating thicknesses can be prevented so that the undercoat layer having the aforementioned effects may be formed. Furthermore, the coating fluid for undercoat layer accomplishes a high can-stability.

The method of producing the photoconductor according to the invention is characterized in that the metal oxide is titanium oxide of a needle-like particulate shape, which is preliminarily surface-treated with the coupling agent, that the solvent is a mixture solvent containing a solvent selected from the group consisting of lower alcohols having 1 to 4 carbon atoms and a solvent selected from the group consisting of dichloromethane, chloroform, 1,2-dichloroethane, 1,2-dichloropropane, toluene, and tetrahydrofran, and that the binder is a polyamide resin soluble in the mixture solvent.

In accordance with the invention, the coating fluid for undercoat layer features a high dispersibility of the metal oxide and homogeneity such that the occurrence of the coating flaws or inconsistent coating thicknesses in the resultant undercoat layer is prevented. Accordingly, there is formed the undercoat layer having the aforementioned effects. Furthermore, the coating fluid for undercoat layer accomplishes a high can-stability.

The method of producing the photoconductor according to the invention is further characterized in that the metal oxide is titanium oxide of a needle-like particulate shape, that the coupling agent serves as a dispersant in the coating fluid for undercoat layer, that the solvent is a mixture solvent containing a solvent selected from the group consisting of lower alcohols having 1 to 4 carbon atoms and a solvent selected from the group consisting of dichloromethane, chloroform, 1,2-dichloroethane, 1,2-dichloropropane, toluene, and tetrahydrofran, and that the binder is a polyamide resin soluble in the mixture solvent.

In accordance with the invention, the coating fluid for undercoat layer features a high dispersibility of the metal oxide and homogeneity such that the occurrence of the coating flaws or inconsistent coating thicknesses in the resultant undercoat layer is prevented. Accordingly, there is formed the undercoat layer having the aforementioned effects. Furthermore, the coating fluid for undercoat layer accomplishes a high can-stability.

It is preferred that a mixture solvent having an azeotropic composition is selected as the aforesaid mixture solvent. The azeotrope means a phenomenon in which under a given pressure, a liquid mixture has the same composition as that in vapor phase so that the mixture solution has a constant boiling point. The azeotropic composition is determined by an arbitrary combination of a solvent selected from the group consisting of the aforesaid lower alcohols and a solvent selected from the group consisting of dichloromethane, chloroform, 1,2-dichloroethane, 1,2-dichloropropane, toluene, and tetrahydrofran. A mixing ratio of the solvents constituting such a mixture solvent is selected from the known mixing ratios. For example, 35 parts by weight of methanol and 65 parts by weight of 1,2-dichloroethane are mixed together to establish the azeotropic composition. The selection of solvents for establishing the azeotropic composition provides a consistent vaporization of the solvents such that the resultant undercoat layer is free from the coating flaws and has a uniform film thickness. Additionally, the coating fluid for undercoat layer is improved in the can-stability.

Types of the coupling agent include silane coupling agents such as an alkoxysilane compound; sililation agents such as composed of an atom, such as halogen, nitrogen, sulfur and the like, combined with silicon; titanate coupling agents, aluminum coupling agents and the like. Examples of the coupling agents with the unsaturated bond include the following compounds such as allyltrimethoxysilane, allyltriethoxysilane, 3-(1-aminopropoxy)-3,3-dimethyl-1-propenyltrimethoxysilane, (3-acryloxypropyl) trimethoxysilane, (3-acryoxypropyl)methyl dimethoxysilane, (3-acyloxypropyl)dimethyl methoxysilane, N-3-(acryloxy-2-hydroxypropyl)-3-aminopropyl triethoxysilane, 3-butenyltriethoxysilane, 2-(chloromethyl)allyltrimethoxysilane, 1,3-divinyltetramethyldisilazane, methacryloxypropyltrimethoxysilane, vinyltrimethoxysilane, vinyltriethoxysilane, O-(vinyloxyethyl)-N-(triethoxysilylpropyl)urethane, allyldimethylchlorosilane, allylmethyldichlorosilane, allyldichlorosilane, allyldimethoxysilane, butenylmethyldichlorosilane and the like.

In both cases where the coupling agent is used as the dispersant and where the coupling agent is used as the surface treatment agent for the metal oxide, the aforesaid coupling agents may be used alone or in combination of two or more types.

The method of surface-treating the metal oxide with the coupling agent falls into two broad categories: a pretreatment method and an integral blending method. The pretreatment method includes a wet process and a dry process. The wet process falls into two categories: an aqueous treatment process such as direct dissolution process, emulsion process, and amine aduct process; and a solvent treatment process.

The wet process includes the steps of putting the metal oxide into a mixture solution containing an organic solvent or water and the aforesaid coupling agent as the surface treatment agent dissolved or suspended therein; agitating the resultant mixture solution for a time period of several minutes to about 1 hour and, if required, heat treating the mixture solution; and filtering off the resultant metal oxide, followed by drying it. Alternatively, the coupling agent may be put in a mixture solution containing the organic solvent or water and the metal oxide dispersed therein and the subsequent steps may be performed the same way as the above. The direct dissolution process employs a coupling agent soluble in water, the emulsion process employs a coupling agent emulsifiable in water, and the amine aduct process employs a coupling agent having a phosphoric acid residue. In the amine aduct process, it is preferred to add to a mixture solution a small amount of a tertiary amine, such as trialkylamine or trialkylolamine, thereby adjusting the pH of the mixture solution to 7 to 10, and to carry out the process while cooling the mixture solution so as to suppress the rise of the liquid temperature due to the neutralization exothermic reaction. The wet process limits a usable coupling agent to those soluble or suspendable in the organic solvent or water which is used.

In the dry process, the aforesaid coupling agent is directly added to the metal oxide and agitated by means of a mixer or the like. It is preferred to preliminarily dry the metal oxide for removal of water on the surfaces thereof. For example, the metal oxide is preliminarily dried at a temperature of about 100° C. in a Henschel mixer or the like which is rotated at a velocity on the order of several ten rpm and thereafter, added with the coupling agent. Alternatively, the coupling agent may be dissolved or dispersed in the organic solvent or water before added to the metal oxide. At this time, the metal oxide may be uniformly mixed with the coupling agent by spraying the agent with a dry air or $N_2$ gas. Subsequent to the addition of the coupling agent, the resultant mixture is preferably agitated for 10 minute at about 80° C. in the mixer rotated at a velocity of not smaller than 1000 rpm.

The integral blending process is adapted such that during the kneading of the metal oxide and the binder, the metal oxide particles are surface-treated.

A doping amount of the coupling agent is suitably selected depending upon a type and shape of the metal oxide particles and is generally selected from a range of between 0.01 wt % and 30 wt % based on the weight of the metal oxide. If the doping amount of the coupling agent is below the aforesaid range, the surface treatment offers no effect. If, on the other hand, the doping amount exceeds the above range, there is little change in the effect obtained from the surface treatment. A preferable doping amount of the coupling agent is selected from a range of between 0.1 wt % and 20 wt % based on the weight of the metal oxide.

Examples of a usable metal oxide include titanium oxide, zinc oxide, tin oxide, aluminum oxide, silicon oxide, zirconium oxide and the like. Of these, particularly preferred is titanium oxide. Any of these metal oxides may be used alone or in combination of plural types.

The aforesaid metal oxide particles may have a granular shape but preferably has a needle-like shape such as of a thin and long bar, column or spindle. The metal oxide particles preferably has a needle-like shape with an aspect ratio L/S of not smaller than 1.5 with 'L' denoting a length of a long axis thereof while 'S' denoting a length of a short axis thereof. A preferred aspect ratio is in a range of between 1.5 and 300. If the aspect ratio is smaller than the above range, less effect of the needle-like shape is attained. On the other hand, if the aspect ratio exceeds the above range, there is little improvement in the effect of the needle-like shape. A more preferred aspect ratio is selected from a range of between 2 and 10.

The long axis L of the metal oxide particle is selected from a range of between 0.002 $\mu$m and 100 $\mu$m whereas the short axis S thereof is selected from a range of between 0.001 $\mu$m and 1 $\mu$m. If the long axis L and the short axis S exceed the above ranges, the coating fluid for undercoat layer presents a less stable dispersibility. If both the lengths L and S are below the above ranges, the effect of the needle-like shape is decreased. A preferred long axis L is selected from a range of between 0.02 $\mu$m and 10 $\mu$m whereas a preferred short axis S is selected from a range of between 0.01 $\mu$m and 0.5 $\mu$m.

Although the aspect ratio and the axis lengths L and S of the metal oxide particle may be determined by means of the gravity sedimentation analysis, the light-permeability particle size distribution analysis or the like, it is preferred to directly measure the lengths by means of an electron microscope.

A proportion of metal oxide based on the total weight of the undercoat layer is selected from a range of between 10 wt % and 99 wt %. If the metal oxide is contained in a proportion of less than 10 wt %, the resultant undercoat layer is lowered in the photosensitivity so as to suffer accumulated static charges and hence, the residual potential thereof is increased. This phenomenon is conspicuous in a case where the photoconductor is repeatedly used under the conditions of low temperatures and low humidities. If the metal oxide is contained in a proportion of more than 99 wt %, the coating fluid for undercoat layer is lowered in the can-stability. This leads to sedimentation of the metal oxide contained in the coating fluid and hence, a decreased homogeneity of the coating fluid results. A preferred proportion of metal oxide based on the total weight of the undercoat layer is selected from a range of between 30 wt % and 99 wt %, and more preferably of between 50 wt % and 95 wt %.

The metal oxide particles may have a granular shape or a needle-like shape. However, there may also be used a mixture of metal oxide particles of the granular shape and of the needle-like shape. In a case where the titanium oxide is used as the metal oxide, the titanium oxide particles may have any one of the crystalline forms including anataze, rutile, and amorphous. Additionally, the titanium oxide particles are not limited to any single crystalline form and plural types of titanium oxide particles with different crystalline forms may be used in combination.

A volume resistance of the metal oxide is selected from a range of between $10^5$ Ω.cm and $10^{10}$ Ω.cm. If the volume resistance of the metal oxide is less than $10^5$ Ω.cm, the undercoat layer containing such a metal oxide has a reduced resistance, thus failing to serve as the charge blocking layer. For example, the undercoat layer containing a metal oxide such as tin oxide doped with antimony for conductivity-imparting treatment suffers an extremely low volume resistance as small as $10^0$ Ω.cm to $10^1$ Ω.cm and hence, is incapable of serving as the charge blocking layer. Thus, the chargeability as the properties of the photoconductor is decreased. If, on the other hand, the metal oxide has a volume resistance value of above $10^{10}$ Ω.cm, which value is equivalent to or greater than that of the binder, the resultant undercoat layer has an excessive resistance so that the transfer of carriers produced by the light irradiation is suppressed and an increased residual potential results. Prior to or subsequent to the surface treatment of the metal oxide with the coupling agent having the unsaturated bond as well as when the coupling agent is used as the dispersant, the metal oxide may be coated with a single compound or a mixture of compounds, which include $Al_2O_3$, $SiO_2$ and ZnO, thereby adjusting the volume resistance of the metal oxide within the aforesaid range.

The material similar to that of the prior art in which the undercoat layer is formed of a single resin component, may be used as the binder. Examples of a usable resin material include polyethylene, polypropylene, polystyrene, acrylic resin, vinyl chloride resin, vinyl acetate resin, polyurethane, epoxy resin, polyester, melamine resin, silicone resin, polyvinylbutyral, polyamide and copolymers containing two or more of repeated units of these resin materials. The usable resin materials further include casein, gelatin, polyvinyl alcohol, ethyl cellulose and the like. Above all, polyamide is particularly preferred in the light of resistance to dissolution or swelling in the solvent used for forming the photosensitive layer on the undercoat layer, excellent adhesion to the substrate and an appropriate degree of flexibility. As to the polyamide, particularly preferred are nylons soluble in alcohol which include, for example, so-called copolymerized nylons such as obtained by copolymerizing 6-nylon, 66-nylon, 610-nylon, 11-nylon, 12-nylon and the like; and chemically modified nylons such as N-alkoxymethyl-modified nylon and N-alkoxyethyl-modified nylon.

The undercoat layer is formed by the use of the coating fluid for undercoat layer which includes the coupling agent having the unsaturated bond, the metal oxide, the binder and the solvent. Specifically, the aforesaid mixture solvent is used as the solvent for the coating fluid so as to overcome the reduction of dispersibility of the metal oxide, which is experienced when a single solvent is used. This also leads to an improved can-stability of the coating fluid, thus allowing for the reuse thereof.

A thickness of the undercoat layer is selected from a range of between 0.01 μm and 20 μm. An undercoat layer less than 0.01 μm in thickness does not substantially serve as the undercoat layer. Such an undercoat layer does not cover the surface flaws of the substrate for accomplishing a consistent surface characteristics nor prevent the carrier injection from the substrate. Hence, a reduced chargeability of the undercoat layer results. With a thickness of greater than 20 μm, the undercoat layer is hard to form and has a decreased mechanical strength. The thickness of the undercoat layer is preferably selected from a range of between 0.05 μm and 10 μm.

In preparation of the coating fluid for undercoat layer, the dispersion of the coating fluid may be prepared by a method utilizing a ball mill, sand mill, attritor, vibration mill, ultrasonic dispersion mixer or the like. A general coating method such as dip coating may be employed for application of the coating fluid.

The substrate may employ a metal drum or a metal sheet such as formed of aluminum, aluminum alloy, copper, zinc, stainless steel and titanium; a drum, a sheet or a seamless belt formed of a polymer material including polyethyleneterephthalate, nylon and polystyrene, and having a metal foil laminated thereto or a metal deposited thereon; and a drum, a sheet or a seamless belt formed of a hard paper and having a metal foil laminated thereto or a metal deposed thereon.

The photosensitive layer formed on the undercoat layer may be of any one of the types, which include a separated-function type composed of a charge generation layer and a charge transport layer, a single-layered type composed of a single layer, and the like. In the separated-function type photosensitive layer, the charge generation layer is formed on the undercoat layer and then the charge transport layer is laid thereover.

The charge generation layer contains a charge generation material. Examples of the charge generation material include bisazo compounds such as Chlorodiane Blue; polycyclic quinone compounds such as dibromoanthanthrone; perylene compounds; quinacridon compounds; phthalocyanine compounds; azulenium salt compounds and the like. These compounds may be used alone or in combination of plural types.

The charge generation layer may be formed by means of a process wherein the charge generation material is vacuum deposited or of a process wherein the charge generation material is dispersed in a solution of a binder resin and the resultant coating solution is applied. The latter process is generally employed. Methods of dispersing the charge generation material in the coating fluid for charge generation layer and of applying the coating fluid may be the same as those employed for the undercoat layer.

Examples of a binding resin contained in the charge generation layer include melamine resins, epoxy resins, silicone resins, polyurethane, acrylic resins, polycarbonate, polyarylate, phenoxy resins, butyral resins and the like. The usable binding resins also include copolymers containing two or more repeated units, such as vinyl chloride-vinyl acetate copolymer, acrylonitrile-styrene copolymer and the like. It is to be noted that the usable binding resins are not limited to these and generally used resin materials may be used alone or in combination of plural types.

Examples of a usable solvent for dissolving the binder resin for use in the charge generation layer include halogenated hydrocarbons such as methylene chloride, ethane dichloride and the like; ketones such as acetone, methyl ethyl ketone, cyclohexanone and the like; esters such as ethyl acetate, butyl acetate and the like; ethers such as tetrahydrofuran, dioxane and the like; aromatic hydrocarbons such as benzene, toluene, xylene and the like; and aprotic polar solvents such as N,N-dimethylformamide, N,N-dimethylacetamide and the like.

A thickness of the charge generation layer is selected from a range of between 0.05 μm and 5 μm, and more preferably of between 0.1 μm and 1 μm.

The charge transport layer contains a charge transport material. Examples of a charge transport material include hydrazone compounds, pyrazolyne compounds, triphenylamine compounds, triphenylmethane compounds, stilbene compounds, oxadiazole compounds and the like. These compounds may be used alone or in combination of plural types.

Similarly to the undercoat layer, the charge transport layer is formed by the method wherein the charge transport material is dissolved in a solution containing the binder resin and the resultant mixture fluid is applied. Examples of a binder resin for use in the charge transport layer include the same resins as those used for the charge generation layer. These resin materials may be used alone or in combination of plural types.

A thickness of the charge transport layer is selected from a range of between 5 μm and 50 μm and more preferably of between 10 μm and 40 μm.

A thickness of a single-layered type photosensitive layer is selected from a range of between 5 μm and 50 μm and more preferably of between 10 μm and 40 μm.

In both cases of the single-layered photosensitive layer and the multi-layered photosensitive layer, the photosensitive layer is preferably of the negative charge so that the undercoat layer may serve as an obstacle against the hole injection from the substrate and that high sensitivity and high durability may be obtained.

For the purposes of improving the sensitivity of the photoconductor and preventing the rise of residual potential and the degradation of photosensitive properties thereof due to repeated use, the photosensitive layer may further contain at least one type of electron acceptor. Examples of a usable electron acceptor include quinone compounds such as parabenzoquinone, chloranil, tetrachloro-1,2-benzoquinone, hydroquinone, 2,6-dimethylbenzoquinone, methyl-1,4-benzoquinone, α-naphthoquinone, β-naphthoquinone and the like; nitro compounds such as 2,4,7-trinitro-9-fluorenone, 1,3,6,8-tetranitrocarbazole, p-nitrobenzophenone, 2,4,5,7-tetranitro-9-fluorenone, 2-nitrofluorenone and the like; and cyano compounds such as tetracyanoethylene, 7,7,8,8-tetracyanoquinodimethane, 4-(p-nitrobenzoiloxy)-2',2'-dicyanovinylbenzene, 4-(m-nitrobenzoiloxy)-2',2'-dicyanovinylbenzene and the like. Of these compounds, particularly preferred are fluorenone compounds, quinone compounds and benzene derivatives having an electron attractive substituent such as Cl, CN, $NO_2$ and the like.

Incidentally, there may be added a UV absorber and an anti-oxidant. Examples of the UV absorber and the anti-oxidant include benzonic acid, stilbene compound and their derivatives; and nitrogen-containing compounds such as triazole compound, imidazole compound, oxadiazil compound, thiazole compound and their derivatives.

If required, there may be provided a protection layer for protecting the photosensitive layer. The protection layer may employ thermoplastic resins, photosetting resins and thermosetting resins. Additionally, the protection layer may further contain the aforesaid UV absorber, anti-oxidant, inorganic material such as metal oxide, organic metal compound, the electron acceptor and the like.

For improvement of the mechanical properties including workability, flexibility and the like of the photosensitive layer and the protection layer, there may further be added a plasticizer such as dibasic acid ester, fatty acid ester, phosphate, phthalate, chlorinated parafin and the like. In addition, there may be added a levelling agent such as silicone resin.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
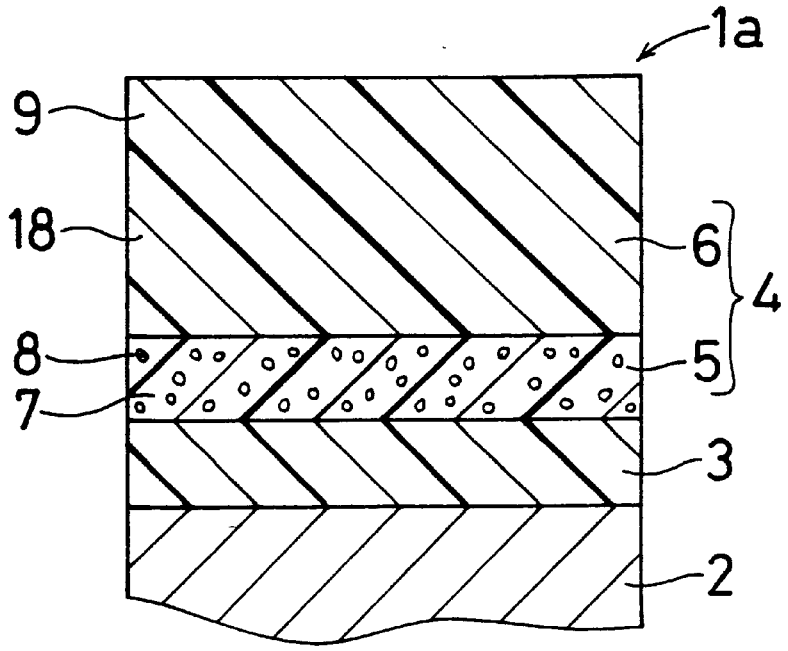
FIGS. 1A and 1B are sectional views for illustrating electrophotographic photoconductors 1*a* and 1*b* according to one embodiment of the invention, respectively.

Now referring to the drawings, preferred embodiments of the invention are described below.

Figure 1B:
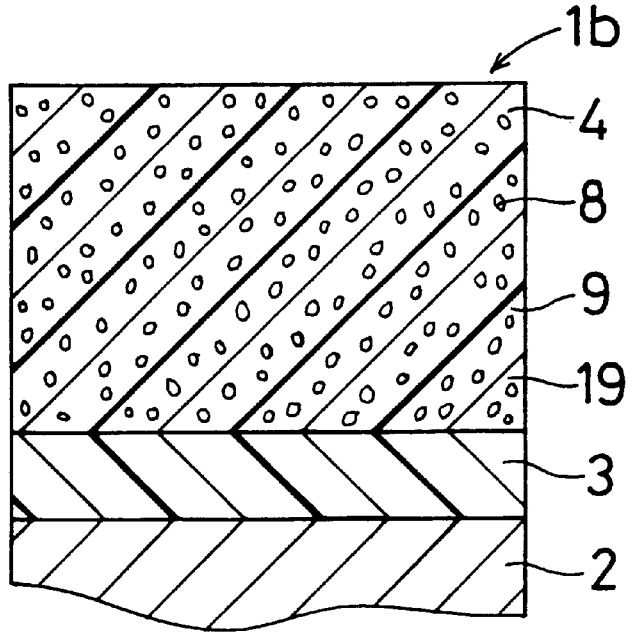

FIGS. 1A and 1B are sectional views for illustrating electrophotographic photoconductors 1*a* and 1*b* (hereinafter, also simply referred to as "photoconductor") according to an embodiment of the invention, respectively. The photoconductors 1*a* and 1*b* each include a conductive substrate 2, an undercoat layer 3 formed on the substrate 2, and a photosensitive layer 4 formed on the undercoat layer 3. The undercoat layer 3 includes a coupling agent having an unsaturated bond, a metal oxide and a binder.

The photoconductor 1*a* shown in FIG. 1A is of a separated-function type. The photosensitive layer 4 of the photoconductor 1*a* includes a charge generation layer 5 and a charge transport layer 6 which are separated from each other. The charge generation layer 5 formed on the undercoat layer 3 includes a binder resin 7 and a charge generation material 8 whereas the charge transport layer 6 formed on the charge generation layer 5 includes a binder resin 18 and a charge transport material 9. The photoconductor 1*b* shown in FIG. 1B is of a single-layered type and has a single-layered photosensitive layer 4. The photosensitive layer 4 includes a binder resin 19, the charge generation material 8 and the charge transport material 9.

Figure 2:
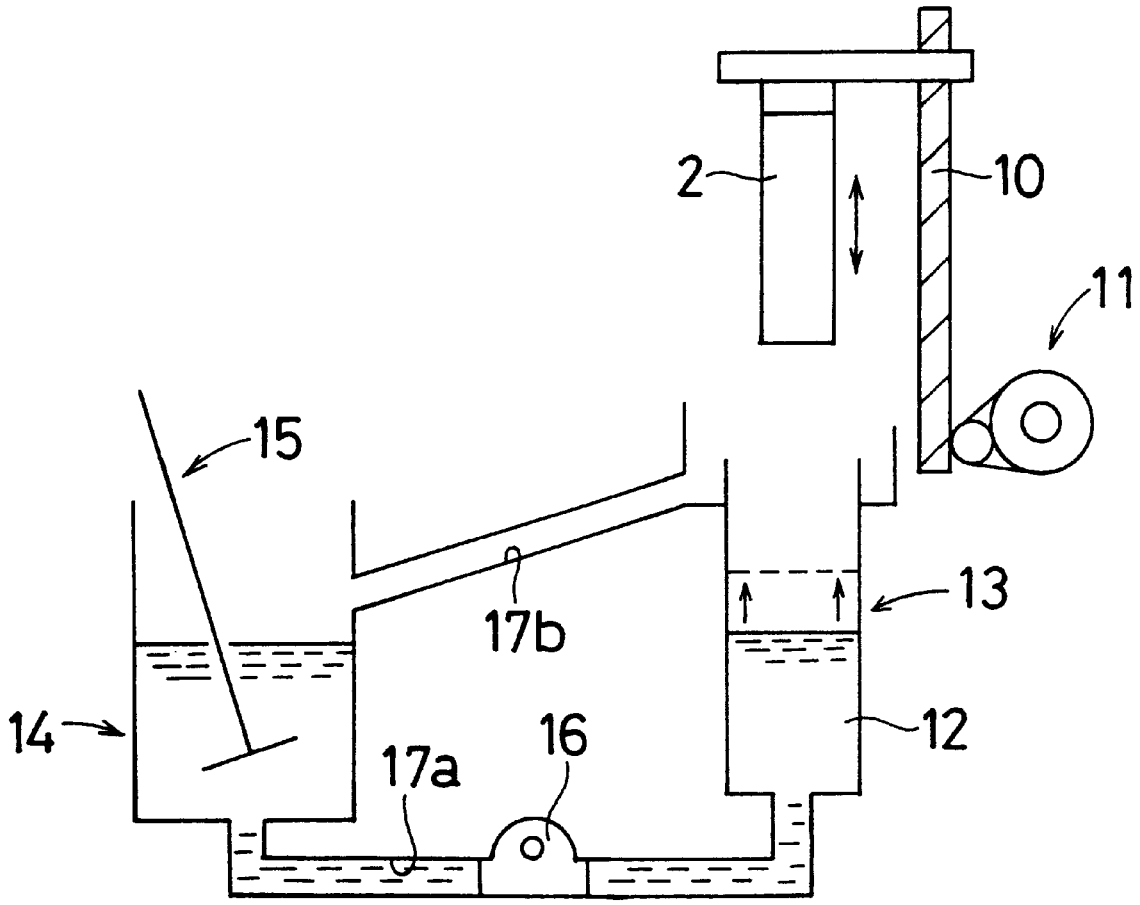
FIG. 2 is a diagram of a dip coating apparatus for illustrating a method of producing the electrophotographic photoconductors 1*a* and 1*b*.

FIG. 2 is a diagram of a dip coating apparatus for illustrating a method of producing the electrophotographic photoconductors 1*a* and 1*b*. A coating fluid bath 13 and an agitating tank 14 contain therein a coating fluid 12. The coating fluid 12 is transported by a motor 16 from the agitating tank 14 through a circulating path 17*a* to the coating fluid bath 13, from which the coating fluid flows to the agitating tank 14 through a circulating path 17*b* inclined downward for connection between an upper portion of the coating fluid bath 13 and the agitating tank 14. In this manner, the coating fluid 12 is circulated. Above the coating fluid bath 13, the substrate 2 is mounted to a rotary shaft 10. An axial direction of the rotary shaft 10 extends in parallel to a vertical direction of the coating fluid bath 13. Rotating the rotary shaft 10 by means of a motor 11 causes the mounted substrate 2 to move vertically.

The motor 11 is rotated in one predetermined direction thereby to lower the substrate 2, which is thus dipped in the coating fluid 12 in the coating fluid bath 13. Subsequently, the motor 11 is rotated reversely of the aforesaid one direction thereby to elevate the substrate 2, which is thus taken out of the coating fluid 12. The substrate 2 with the coating fluid thereon is dried whereby a film of the coating fluid 12 is formed thereon. The undercoat layer 3, the charge generation layer 5 and charge transport layer 6 of the separated-function type photosensitive layer 4, and the single-layered type photosensitive layer 4 may be formed by this dip coating method. A coating fluid for undercoat layer includes a coupling agent having an unsaturated bond, a metal oxide, a binder and a solvent.

Examples 1 to 66 according to the invention will hereinbelow be described.

EXAMPLE 1

First, 0.02 g of methacryloxypropyl trimethoxysilane (commercially available as S710 from Chisso Corporation)

as a coupling agent having an unsaturated bond was added to 500 g of n-hexane. While agitated, the resultant mixture solution was added with 20 g of granular zinc oxide (commercially available as FINEX-50 from Sakai Chemical Industry Co., Ltd. and having a mean particle size of 0.01 μm to 0.04 μm) and was further agitated for 1 hour. Subsequently, the granules of zinc oxide were filtered off and dried by heating at 100° C. for 3 hours. Thus were obtained the zinc oxide granules surface-treated with the coupling agent having the unsaturated bond. It is to be noted that the zinc oxide granules employed by this embodiment were not subject to a surface treatment for conductivity impartation.

Next, 17.1 parts by weight of zinc oxide thus surface-treated with the coupling agent and 0.9 parts by weight of copolymer nylon resin (commercially available as CM8000 from Toray Industries, Inc.), as the binder, were added to a mixture solvent containing 28.7 parts by weight of methyl alcohol and 53.3 parts by weight of 1,2-dichloroethane. The resultant mixture solution was agitated for dispersion by a paint shaker for 8 hours. Thus was prepared a coating fluid for undercoat layer.

The coating fluid for undercoat layer thus prepared was put in a 2-mm thick cell so that a turbidity of the fluid fresh from the shaker was measured by means of an integrating sphere type turbidimeter (commercially available as SEP-PT-501D from Mitsubishi Chemical Industries Ltd.). A dispersibility of the coating fluid for undercoat layer was evaluated based on this result. After allowed to stand for 90 days, the coating fluid for undercoat layer was measured on a turbidity thereof in the same manner as the above. A can-stability of the coating fluid for undercoat layer was evaluated based on this result. The results are shown in Table 1.

EXAMPLES 2 TO 4

The zinc oxide of Example 1 was replaced by granular tin oxide (commercially available as S-1 from Mitsubishi Materials Corporation and having a mean particle size of 0.02 μm) in Example 2, by granular silicon oxide (commercially available as AEROSIL200 from Nippon Aerosil Co., Ltd. and having a mean particle size of 0.012 μm) in Example 3, and by granular aluminum oxide (commercially available as Aluminium Oxide C from Nippon Aerosil Co., Ltd. and having a mean particle size of 0.013 μm) in Example 4. Except for the above, the subsequent steps were performed in the same manner as in Example 1, thereby surface-treating the granules with the coupling agent having the unsaturated bond, and preparing a coating fluid for undercoat layer of the respective examples. Turbidities of the resultant coating fluids were measured immediately after the preparation thereof and 90 days later. The results are shown in Table 1.

EXAMPLES 5 TO 9

The zinc oxide of Example 1 was replaced by granular titanium oxide which was not subject to the surface treatment (commercially available as TTO-55N from Ishihara Sangyo Kaisya, Ltd. and having a mean particle size of 0.03 μm to 0.05 μm) in Example 5, and by granular titanium oxide which was subject to the surface treatment with $Al_2O_3$ (commercially available as TTO-55A from Ishihara Sangyo Kaisya, Ltd. and having a mean particle size of 0.03 μm to 0.05 μm) in Example 6. Example 7 employed needle-shaped particles of titanium oxide which were not subject to the surface treatment (commercially available as STR-60N from Sakai Chemical Industry Co., Ltd. and having a long axis L of 0.05 μm, a short axis S of 0.01 μm and an aspect ratio of 5), whereas Example 8 employed needle-shaped particles of titanium oxide which were subject to the surface treatment with $Al_2O_3$ (commercially available as STR-60 from Sakai Chemical Industry Co., Ltd. and having a long axis L of 0.05 μm, a short axis S of 0.01 μm and an aspect ratio of 5). Example 9 employed needle-shaped particles of titanium oxide which were subject to the surface treatment with $Al_2O_3$ and $SiO_2$ (commercially available as STR-60A from Sakai Chemical Industry Co., Ltd. and having a long axis L of 0.05 μm, a short axis S of 0.01 μm and an aspect ratio of 5). Except for the above, the subsequent steps were performed in the same manner as in Example 1, thereby surface-treating the particles with the coupling agent having the unsaturated bond, preparing coating fluids for undercoat layer of these examples, and measuring turbidities of the coating fluids immediately after the preparation thereof and 90 days later. The results are shown in Table 1.

EXAMPLE 10

In Example 10, the zinc oxide of Example 1 was replaced by needle-shaped particles of titanium oxide which were subject to the surface treatment with $SiO_2$ (commercially available as STR-60S from Sakai Chemical Industry Co., Ltd. and having a long axis L of 0.05 μm, a short axis S of 0.01 μm and an aspect ratio of 5). As to the coupling agent having the unsaturated bond, methacryloxypropyl trimthoxysilane was replaced by a titanate coupling agent (commercially available as KR55 from Ajinomoto Co., Inc.). Except for the above, the subsequent steps were performed in the same manner as in Example 1, thereby surface-treating the particles with the coupling agent having the unsaturated bond, preparing a coating fluid for undercoat layer and measuring turbidities of the coating fluid immediately after the preparation thereof and 90 days later. The results are shown in Table 1.

Comparative Examples 1 to 10

In Comparative Examples 1 to 10, coating fluids for undercoat layer were prepared in the same manner as in Example 1 except for that the metal oxides were not surface-treated with the aforesaid coupling agent. Turbidities of the respective coating fluids were measured immediately after the preparation thereof and 90 days later. The results are shown in Table 2.

TABLE 1

| | Coating fluid for undercoat layer | |
|---|---|---|
| Examples | Turbidity of fresh fluid | Turbidity 90 days later |
| 1 | 92 | 91 |
| 2 | 103 | 102 |
| 3 | 106 | 103 |
| 4 | 108 | 105 |
| 5 | 93 | 92 |
| 6 | 98 | 99 |
| 7 | 87 | 86 |
| 8 | 90 | 93 |
| 9 | 93 | 90 |
| 10 | 102 | 259 |

TABLE 2

| Comp. Examples | Coating fluid for undercoat layer | |
|---|---|---|
| | Turbidity of fresh fluid | Turbidity 90 days later |
| 1 | 312 | 50 Aggregation/sedimentation observed |
| 2 | 425 | 72 Aggregation/sedimentation observed |
| 3 | 485 | Gelation |
| 4 | 352 | 153 Aggregation/sedimentation observed |
| 5 | Aggregation/sedimentation of all the particles | Aggregation/sedimentation of all the particles |
| 6 | 211 | 79 Aggregation/sedimentation observed |
| 7 | 70 | 37 Aggregation/sedimentation observed |
| 8 | 108 | 51 Aggregation/sedimentation observed |
| 9 | 257 | 105 Aggregation/sedimentation observed |
| 10 | 381 | 172 Aggregation/sedimentation observed |

As to the dispersibilities of the coating fluids immediately after the preparation thereof, the tables show that the coating fluids of Examples 1 to 4, 6 and 8 to 10 presented more excellent dispersibilities with lower turbidities and higher transparencies than those of corresponding Comparative Examples. In Comparative Example 5 corresponding to Example 5, the existence of aggregation and sediment was observed immediately after the preparation of the coating fluid. As to the can-stability, all the coating fluids of Examples 1 to 10 substantially maintained their initial turbidities whereas those of corresponding Comparative Examples suffered the production of aggregation and sediment or the gelation. It is to be understood that the use of the metal oxide surface-treated with the coupling agent having the unsaturated bond provides the coating fluid for undercoat layer presenting excellent dispersibility immediately after the preparation thereof. Furthermore, such a coating fluid features stability in the dispersibility while stored over an extended period of time. However, the coating fluid of Example 10 presented an excellent initial dispersibility but was increased in the turbidity after storage. Incidentally, the reduced turbidities of the coating fluids of most of the Comparative Examples are attributable to increased transparencies of supernatant liquids of the respective coating fluids due to the aggregation and sedimentation.

EXAMPLE 11

In this example, methacryloxypropyl trimethoxysilane of Example 1, as the coupling agent having the unsaturated bond, was replaced by allyltrimethoxysilane (commercially available as AO567 from Chisso Corporation). Furthermore, the granular zinc oxide was replaced by granular titanium oxide (commercially available as MT-600B from Tayca Corporation and having a mean particle size of 0.05 μm). Except for the above, the subsequent steps were performed in the same manner as in Example 1, thereby surface-treating the granules with the coupling agent having the unsaturated bond, preparing a coating fluid for undercoat layer, and measuring turbidities of the coating fluid immediately after the preparation thereof and 90 days later. The results are shown in Table 3.

EXAMPLE 12

In this example, methacryloxypropyl trimethoxysilane of Example 1, as the coupling agent having the unsaturated bond, was replaced by allyltrimethoxysilane (commercially available as AO567 from Chisso Corporation). Furthermore, the granular zinc oxide was replaced by needle-shaped particles of titanium oxide (commercially available as MT-150A from Tayca Corporation and having a long axis L of 0.1 μm, a short axis S of 0.01 μm and an aspect ratio of 10). Except for the above, the subsequent steps were performed in the same manner as in Example 1, thereby surface-treating the particles with the coupling agent having the unsaturated bond, preparing a coating fluid for undercoat layer, and measuring turbidities of the coating fluid immediately after the preparation thereof and 90 days later. The results are shown in Table 3.

EXAMPLES 13 TO 15

Allyltrimethoxysilane of Example 12, as the coupling agent having the unsaturated bond, was replaced by vinyl triethoxysilane (commercially available as S220 from Chisso Corporation) in Example 13, by 1,3-divinyl tetramethyldisilazane (commercially available from Chisso Corporation) in Example 14, and by butenyl methyl dichlorosilane (commercially available from Chisso Corporation) in Example 15. Except for the above, the subsequent steps were performed in the same manner as in Example 12, thereby surface-treating the particles with the respective coupling agents having the unsaturated bond, preparing coating fluids for undercoat layer and measuring turbidities of the coating fluids immediately after the preparation thereof and 90 days later. The results are shown in Table 3.

Comparative Examples 11 to 15

In these comparative examples, coupling agents free from the unsaturated bond were used instead of the coupling agents of corresponding Examples 11 to 15. Comparative Example 11 employed dodecyltriethoxysilane (commercially available from Chisso Corporation), whereas Comparative Example 12 employed methyl trimethoxysilane (commercially available as TSL8113 from Toshiba Silicone Co., Ltd.). Comparative Example 13 employed (tridecafluoro-1,1,2,2-tetrahydrooctyl)triethoxysilane (commercially available from Chisso Corporation), whereas Comparative Example 14 employed trimethyl chlorosilane (commercially available as TSL8031 from Toshiba Silicone Co., Ltd.) serving as a sililation agent. Comparative Example 15 employed diphenyldichlorosilane (commercially available as TSL8062 from Toshiba Silicone Co., Ltd.). Except for the above, the subsequent steps were performed in the same manner as in corresponding Examples 11 to 15, thereby surface-treating the particles with the respective coupling agents free from the unsaturated bond, preparing coating fluids for undercoat layer, and measuring turbidities of the coating fluids immediately after the preparation thereof and 90 days later. The results are shown in Table 4.

EXAMPLE 16

To a mixture solvent containing 28.7 parts by weight of methyl alcohol and 53.3 parts by weight of 1,2-dichloroethane, there were added 17.1 parts by weight of needle-shaped particles of titanium oxide (commercially available as STR-60N from Sakai Chemical Industry Co., Ltd. and having a long axis L of 0.05 μm, a short axis S of 0.01 μm and an aspect ratio of 5), 0.9 parts by weight of copolymer nylon resin (commercially available as CM8000 from Toray Industries, Inc.) as the binder, and 0.171 parts by weight of (3-acryloxypropyl)trimethoxysilane (commercially available from Chisso Corporation) as the coupling agent with the unsaturated bond. The resultant mixture solution was agitated for dispersion by the paint shaker for 8 hours and thus was prepared a coating fluid for undercoat layer. In this example, the coupling agent served as a dispersant in the coating fluid for undercoat layer. Turbidities of the coating fluid were measured immediately after the preparation thereof and 90 days later in the same manner as in Example 1. The results are shown in Table 3.

EXAMPLES 17 AND 18

The needle-shaped particles of titanium oxide of Example 16 were replaced by needle-shaped particles of titanium oxide having a long axis L of 3 μm to 6 μm, a short axis S of 0.05 μm to 0.1 μm and an aspect ratio of 30 to 120 (commercially available as FTL-100 from Ishihara Sangyo Kaisha, Ltd.) in Example 17, and by needle-shaped particles of titanium oxide having a long axis L of 4 μm to 12 μm, a short axis S of 0.05 μm to 0.15 μm and an aspect ratio of 27 to 240 (commercially available as FTL-200 from Ishihara Sangyo Kaisha, Ltd.) in Example 18. Except for the above, the subsequent steps were performed in the same manner as in Example 16, thereby preparing coating fluids for undercoat layer and measuring turbidities of the coating fluids immediately after the preparation thereof and 90 days later. The results are shown in Table 3.

EXAMPLE 19

In this example, the copolymer nylon resin as the binder of Example 16 was replaced by an N-methoxymethylated nylon resin (commercially available as EF-30T from Teikoku Chemical Industries Co., Ltd.). Except for this, the subsequent steps were performed in the same manner as in Example 16, thereby preparing a coating fluid for undercoat layer and measuring turbidities of the coating fluid immediately after the preparation thereof and 90 days later. The results are shown in Table 3.

Comparative Example 16

In this comparative example, the copolymer nylon resin as the binder of Example 16 was replaced by a vinyl chloride-vinyl acetate-maleic acid copolymer resin (commercially available as Esreck M from Sekisui Chemical Co., Ltd.). Except for this, the subsequent steps were performed in the same manner as in Example 16, thereby preparing a coating fluid for undercoat layer and measuring turbidities of the coating fluid immediately after the preparation thereof and 90 days later. The results are shown in Table 4.

TABLE 3

| | Coating fluid for undercoat layer | |
|---|---|---|
| Examples | Turbidity of fresh fluid | Turbidity 90 days later |
| 11 | 114 | 101 |
| 12 | 75 | 71 |
| 13 | 79 | 72 |
| 14 | 83 | 80 |
| 15 | 90 | 85 |
| 16 | 69 | 66 |
| 17 | 103 | 100 |
| 18 | 121 | 117 |
| 19 | 74 | 72 |

TABLE 4

| Comp. | Coating fluid for undercoat layer | |
|---|---|---|
| Examples | Turbidity of fresh fluid | Turbidity 90 days later |
| 11 | 481 | Aggregation/sedimentation of all the particles |
| 12 | 392 | 121 Aggregation/sedimentation observed |
| 13 | 453 | Aggregation/sedimentation of all the particles |
| 14 | 389 | 131 Aggregation/sedimentation observed |
| 15 | 401 | 144 Aggregation/sedimentation observed |
| 16 | 259 | Gelation |

As to the dispersibilities immediately after the preparation of the coating fluids, the tables show that the coating fluids of Examples 11 to 19 presented more excellent dispersibilities with lower turbidities and higher transparencies than those of corresponding Comparative Examples. As to the can-stability, all the coating fluids of Examples 11 to 19 substantially maintained their initial turbidities whereas those of corresponding Comparative Examples suffered the production of aggregation and sediment or the gelation. Accordingly, it is to be understood that the coating fluid containing the metal oxide surface-treated with the coupling agent with the unsaturated bond, the binder and the mixture solvent accomplishes more excellent dispersibility immediately after the preparation thereof, as compared with the coating fluid for undercoat layer containing the metal oxide surface-treated with the coupling agent free from the unsaturated bond. Furthermore, the coating fluids of these examples maintains stability in the dispersibility while stored over an extended period of time. It is also to be understood that the coating fluid for undercoat layer employing the coupling agent with the unsaturated bond as the dispersant and polyamide as the binder presents more excellent dispersibility and can-stability than the coating fluid for undercoat layer employing a like coupling agent as the dispersant and a resin other than polyamide as the binder.

EXAMPLE 20

To a mixture solvent containing 28.7 parts by weight of methyl alcohol and 53.3 parts by weight of 1,2-dichloroethane, there were added 1.8 parts by weight of needle-shaped particles of titanium oxide (commercially available as STR-60N from Sakai Chemical Industry Co., Ltd. and having a powder resistance of $9\times10^5$ Ω.cm, a long axis L of 0.05 μm, a short axis S of 0.01 μm and an aspect ratio of 5), 16.182 parts by weight of copolymer nylon resin (commercially available as CM8000 from Toray Industries, Inc.) as the binder, and 0.018 parts by weight of methacrylamidepropyl triethoxysilane (commercially available from Chisso Corporation). The resultant mixture solution was agitated for dispersion by the paint shaker for 8 hours and thus was prepared a coating fluid for undercoat layer. In this example, the coupling agent served as the dispersant in the coating fluid for undercoat layer.

The coating fluid for undercoat layer was applied to a 100-μm thick conductive substrate formed of aluminum by means of a baker applicator and subject to a hot-air drying process at 110° C. for 10 minutes, thereby to form an undercoat layer having a thickness of 3.0 μm in dry state. All the contained solvent substantially evaporated during the drying process so that the undercoat layer included the needle-shaped particles of titanium oxide, copolymer nylon and coupling agent with the unsaturated bond. At this time, a proportion of needle-shaped particles of titanium oxide was 10 wt % relative to the total weight of the undercoat layer whereas a proportion of coupling agent was 1 wt % relative to the weight of the titanium oxide.

In order to produce the separated-function type photoconductor shown in FIG. 1A, the charge generation layer was formed on the undercoat layer thus formed. More specifically, a mixture solution containing 1.5 parts by weight of bisazo pigment (Chlorodiane Blue) represented by the following chemical formula 1 and 1.5 parts by weight of phenoxy resin (commercially available as PKHH from Union Carbide Corporation) was added to 97 parts by weight of 1,2-dimethoxyethane and agitated for dispersion by the paint shaker for 8 hours. Thus was prepared a coating fluid for charge generation layer. The coating fluid for charge generation layer was applied to the undercoat layer by means of the baker applicator and subject to the hot-air drying process at 90° C. for 10 minutes, thereby to form a charge generation layer having a thickness of 0.8 μm in dry state.

[Chemical Formula 1]

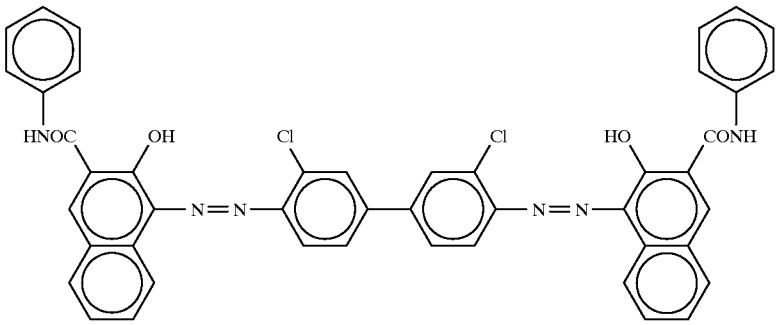

Next, a charge transport layer was laid over the charge generation layer thus formed. More specifically, a mixture solution containing 1 part by weight of hydrazone compound represented by the following chemical formula 2, 0.5 parts by weight of polycarbonate (commercially available as Z-200 from Mitsubishi Gas Chemical Co., Ltd.) and 0.5 parts by weight of polyarylate (commercially available as U-100 from Unitika Ltd.) was added to 8 parts by weight of dichloromethane and agitated for dissolution by means of a magnetic stirrer. Thus was prepared a coating fluid for charge transport layer. The coating fluid for charge transport layer was applied to the charge generation layer by means of the baker applicator and subject to the hot-air drying process at 80° C. for 1 hour, thereby to form a charge transport layer having a thickness of 20 μm in dry state.

[Chemical Formula 2]

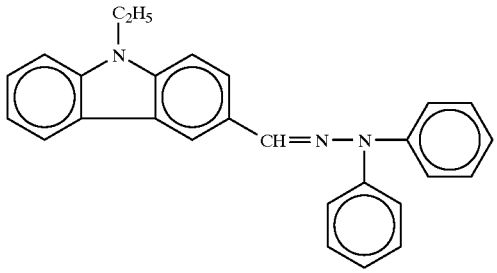

The separated-function type photoconductor thus produced was mounted to an image forming apparatus (commercially available as SF-8870 from Sharp Corporation) so as to measure a surface potential of the photoconductor in a development station of the apparatus. More specifically, measurement was taken on a surface potential VO of the photoconductor subject to processes under darkness except for a light exposure process, a surface potential VR of the photoconductor after static elimination, and a surface potential VL of the photoconductor at a white area during the light exposure process. The chargeability of the photoconductor can be evaluated based on the surface potential VO while the sensitivity thereof can be evaluated based on the surface potential VL.

The surface potentials VO, VR and VL of the photoconductor were measured immediately after the production thereof and after 20,000 times of use thereof. The measurement for evaluation was carried out under low-temperature, low-humidity conditions of 5° C./20% RH (hereinafter referred to as "L/L environment"), under normal-temperature, normal-humidity conditions of 25° C./60% RH (hereinafter referred to as "N/N environment"), and under high-temperature, high-humidity conditions of 35° C./85% RH (hereinafter referred to as "H/H environment"). The results are shown in Table 5.

EXAMPLES 21 TO 24

In these examples, the proportion of needle-shaped particles of titanium oxide relative to the total weight of the undercoat layer was varied from 10 wt % in Example 20. That is, the titanium oxide was contained in proportions of 50 wt %, 80 wt %, 95 wt % and 99 wt % relative to the undercoat layer in Examples 21 to 24, respectively. It is to be noted that the coupling agent with the unsaturated bond was constantly contained in the proportion of 1 wt % relative to the titanium oxide. Except for the above, the subsequent steps were performed in the same manner as in Example 20, thereby forming undercoat layers and then producing photoconductors, which were measured on the surface potentials VO, VR and VL thereof, respectively. The results are shown in Table 5.

EXAMPLES 25 TO 29

In these examples, the copolymer nylon resin used as the binder for the undercoat layers of Examples 20 to 24 was replaced by the N-methoxymethylated nylon resin (commercially available as EF-30T from Teikoku Chemical Industries Co., Ltd.). Except for this, the subsequent steps were performed in the same manner as in the corresponding examples, thereby forming undercoat layers and then photoconductors, which were measured on the surface potentials VO, VR and VL thereof, respectively. The results are shown in Table 5.

Comparative Examples 17 to 20

In these comparative examples, the needle-shaped particles of titanium oxide employed by Examples 20 to 24 were replaced by needle-shaped particles of titanium oxide which were subject to the surface treatment with $SnO_2$ (Sb doping) for conductivity impartation (commercially available as FTL-1000 from Ishihara Sangyo Kaisha, Ltd. and having a powder resistance of $1\times10^1$ Ω.cm, a long axis L of 3 μm to 6 μm, a short axis S of 0.05 μm to 0.1 μm, and an aspect ratio of 30 to 120). Except for this, the subsequent steps were performed in the same manner as in the corresponding examples, thereby forming undercoat layers and then photoconductors, which were measured on the surface potentials VO, VR and VL thereof, respectively. The results are shown in Table 6.

Comparative Examples 21 to 24

In these comparative examples, the copolymer nylon resin used as the binder for the undercoat layers of Comparative Examples 17 to 20 was replaced by the N-methoxymethylated nylon resin (commercially available as EF-30T from Teikoku Chemical Industries Co., Ltd.). Except for this, the subsequent steps were performed in the same manner as in the corresponding examples, thereby forming undercoat layers and then photoconductors, which were measured on the surface potentials VO, VR and VL thereof, respectively. The results are shown in Table 6.

Comparative Example 25

Although the undercoat layer of Example 20 contained the needle-shaped particles of titanium oxide in the proportion of 10 wt %, the particles of titanium oxide were contained in a proportion of 8 wt % based on the total weight of the undercoat layer of this comparative example. Incidentally, the coupling agent with the unsaturated bond was contained in a proportion of 1 wt % based on the weight of the titanium oxide. Except for this, the subsequent steps were performed in the same manner as in Example 20, thereby forming an undercoat layer and then a photoconductor, which was measured on the surface potentials VO, VR and VL thereof. The results are shown in Table 6.

Comparative Example 26

Although the undercoat layer of Example 25 contained the needle-shaped particles of titanium oxide in the proportion of 10 wt %, the particles of titanium oxide were contained in a proportion of 8 wt % based on the total weight of the undercoat layer of this comparative example. Incidentally, the coupling agent with the unsaturated bond was contained in a proportion of 1 wt % based on the weight of the titanium oxide. Except for this, the subsequent steps were performed in the same manner as in Example 25, thereby forming an undercoat layer and then a photoconductor, which was measured on the surface potentials VO, VR and VL thereof. The results are shown in Table 6.

TABLE 5

| Example | $TiO_2$ | | | Measurement | Initial (−V) | | | After 20000 times of use (−V) | | |
|---|---|---|---|---|---|---|---|---|---|---|
| No. | Type | w % | Binder | environment | $V_O$ | $V_R$ | $V_L$ | $V_O$ | $V_R$ | $V_L$ |
| 20 | A | 10 | a | L/L | 715 | 28 | 159 | 709 | 21 | 150 |
| | | | | N/N | 709 | 16 | 145 | 701 | 17 | 149 |
| | | | | H/H | 711 | 11 | 143 | 710 | 17 | 151 |
| 21 | A | 50 | a | L/L | 709 | 17 | 155 | 701 | 15 | 151 |
| | | | | N/N | 719 | 15 | 148 | 714 | 18 | 150 |
| | | | | H/H | 716 | 13 | 146 | 712 | 16 | 147 |
| 22 | A | 80 | a | L/L | 708 | 14 | 147 | 702 | 10 | 145 |
| | | | | N/N | 710 | 11 | 148 | 707 | 14 | 152 |
| | | | | H/H | 713 | 10 | 143 | 704 | 16 | 149 |
| 23 | A | 95 | a | L/L | 707 | 12 | 146 | 700 | 10 | 143 |
| | | | | N/N | 706 | 10 | 144 | 702 | 12 | 145 |
| | | | | H/H | 712 | 9 | 145 | 706 | 10 | 147 |
| 24 | A | 99 | a | L/L | 701 | 11 | 144 | 700 | 10 | 143 |
| | | | | N/N | 706 | 9 | 142 | 705 | 8 | 141 |
| | | | | H/H | 710 | 8 | 140 | 705 | 10 | 142 |
| 25 | A | 10 | b | L/L | 720 | 28 | 160 | 709 | 20 | 151 |
| | | | | N/N | 718 | 24 | 156 | 715 | 27 | 159 |
| | | | | H/H | 717 | 20 | 151 | 713 | 19 | 160 |
| 26 | A | 50 | b | L/L | 716 | 23 | 153 | 712 | 21 | 151 |
| | | | | N/N | 715 | 20 | 149 | 711 | 18 | 147 |
| | | | | H/H | 705 | 19 | 147 | 710 | 22 | 150 |

TABLE 5-continued

| Example | $TiO_2$ | | | Measurement | Initial (−V) | | | After 20000 times of use (−V) | | |
|---|---|---|---|---|---|---|---|---|---|---|
| No. | Type | w % | Binder | environment | $V_O$ | $V_R$ | $V_L$ | $V_O$ | $V_R$ | $V_L$ |
| 27 | A | 80 | b | L/L | 701 | 14 | 145 | 700 | 13 | 143 |
| | | | | N/N | 717 | 14 | 144 | 709 | 16 | 147 |
| | | | | H/H | 716 | 13 | 143 | 713 | 15 | 145 |
| 28 | A | 95 | b | L/L | 706 | 17 | 145 | 700 | 12 | 142 |
| | | | | N/N | 717 | 15 | 143 | 710 | 10 | 144 |
| | | | | H/H | 713 | 10 | 142 | 715 | 13 | 140 |
| 29 | A | 99 | b | L/L | 704 | 15 | 146 | 698 | 9 | 143 |
| | | | | N/N | 710 | 11 | 140 | 702 | 9 | 142 |
| | | | | H/H | 713 | 10 | 139 | 711 | 12 | 141 |

$TiO_2$ A:STR-60N needle-shaped, available from Sakai C.I.C.L., 0.05 μm × 0.01 μm, methacrylamidepropyl triethoxysilane 1 w %
Binder
a:CM-8000 copolymer nylon, available from Toray I.I.
b:EF-30T N-methoxymethylated nylon, available from Teikoku C.I.C.L.

TABLE 6

| Comp. Example | $TiO_2$ | | | Measurement | Initial (−V) | | | After 20000 times of use (−V) | | |
|---|---|---|---|---|---|---|---|---|---|---|
| No. | Type | w % | Binder | environment | $V_O$ | $V_R$ | $V_L$ | $V_O$ | $V_R$ | $V_L$ |
| 17 | C | 10 | a | L/L | 659 | 18 | 109 | 125 | 2 | 18 |
| | | | | N/N | 662 | 10 | 101 | 139 | 2 | 15 |
| | | | | H/H | 658 | 9 | 102 | 146 | 2 | 12 |
| 18 | C | 50 | a | L/L | 621 | 15 | 92 | 101 | 2 | 13 |
| | | | | N/N | 631 | 9 | 85 | 97 | 1 | 14 |
| | | | | H/H | 635 | 8 | 86 | 99 | 1 | 12 |
| 19 | C | 80 | a | L/L | 601 | 7 | 82 | 83 | 1 | 10 |
| | | | | N/N | 624 | 6 | 80 | 79 | 1 | 12 |
| | | | | H/H | 621 | 6 | 81 | 81 | 1 | 11 |
| 20 | C | 99 | a | L/L | 536 | 4 | 75 | 75 | 1 | 10 |
| | | | | N/N | 524 | 3 | 72 | 72 | 0 | 9 |
| | | | | H/H | 528 | 4 | 74 | 76 | 0 | 9 |
| 21 | C | 10 | b | L/L | 662 | 19 | 108 | 126 | 2 | 13 |
| | | | | N/N | 667 | 11 | 103 | 124 | 2 | 12 |
| | | | | H/H | 665 | 9 | 102 | 131 | 2 | 10 |
| 22 | C | 50 | b | L/L | 617 | 16 | 94 | 100 | 2 | 9 |
| | | | | N/N | 624 | 10 | 87 | 89 | 1 | 10 |
| | | | | H/H | 621 | 10 | 86 | 93 | 1 | 11 |
| 23 | C | 80 | b | L/L | 597 | 9 | 81 | 82 | 1 | 10 |
| | | | | N/N | 615 | 7 | 82 | 81 | 1 | 10 |
| | | | | H/H | 620 | 6 | 80 | 79 | 1 | 11 |
| 24 | C | 99 | b | L/L | 536 | 5 | 72 | 75 | 0 | 9 |
| | | | | N/N | 526 | 5 | 71 | 71 | 0 | 9 |
| | | | | H/H | 525 | 4 | 73 | 74 | 0 | 9 |
| 25 | A | 8 | a | L/L | 721 | 38 | 165 | 733 | 68 | 207 |
| | | | | N/N | 712 | 24 | 152 | 709 | 27 | 154 |
| | | | | H/H | 713 | 20 | 146 | 711 | 22 | 149 |
| 26 | A | 8 | b | L/L | 725 | 43 | 170 | 730 | 77 | 210 |
| | | | | N/N | 717 | 26 | 155 | 713 | 29 | 159 |
| | | | | H/H | 715 | 22 | 147 | 712 | 25 | 150 |

$TiO_2$ C: FTL-1000 needle-shaped, conductivity-imparting treatment with $SnO_2$ (Sb-doping), available from Ishihara S.K.L. 3–6 μm × 0.05 μm–0.1 μm, methacrylamidepropyl triethoxysilane 1 w %
A: STR-60N needle-shaped, available from Sakai C.I.C.L., 0.05 μm × 0.1 μm, methacrylamidepropyl triethoxysilane 1 w %
Binder
a:CM-8000 copolymer nylon, available from Toray I.I.
b:EF-30T N-methoxymethylated nylon, available from Teikoku C.I.C.L.

As to the undercoat layer containing the needle-shaped particles of titanium oxide, the coupling agent with the unsaturated bond and the binder composed of polyamide, excellent photosensitive properties were obtained if the proportion of needle-shaped particles of titanium oxide relative to the total weight of the undercoat layer was in a range of between 10 wt % to 99 wt %. As to the undercoat layer containing the needle-shaped particles of titanium oxide surface-treated for conductivity impartation, the coupling agent with the unsaturated bond and the binder composed of polyamide, with increase in the proportion of needle-shaped particles of titanium oxide relative to the total weight of the undercoat layer, the undercoat layer was gradually decreased in the surface potential VO, and was seriously decreased in the surface potential VO after 20,000 times of use thereof so that the undercoat layer became almost unchargeable. A significantly reduced proportion of needle-shaped particles of titanium oxide resulted in the rise of the residual potential, particularly under the L/L environment, thus presenting degraded photosensitivity.

EXAMPLE 30

Example 30 employed a drum-shaped substrate. The substrate was formed of aluminum and had a thickness(t) of 1 mm, a diameter (ϕ) of 80 mm, a length of 348 mm and a maximum surface roughness of 0.5 μm. Such a substrate was subject to the dip coating apparatus shown in FIG. 2 thereby applying to a surface thereof the coating fluid for undercoat layer prepared in Example 12. Except for this, the subsequent steps were performed in the same manner as in Example 20, thereby forming an undercoat layer and further forming thereon a charge generation layer and a charge transport layer. Thus was produced a photoconductor of this example, which was mounted to the image forming apparatus (commercially available as SF-8870 from Sharp Corporation) for evaluation of characteristics of a produced image. The results are shown in Table 7.

EXAMPLES 31 TO 34

As one of the solvents composing the mixture solvent contained in the coating fluid for undercoat layer of Example 30, 1,2-dichloroethane was replaced by 1,2-dichloropropane in Example 31, by chloroform in Example 32, by tetrahydrofuran in Example 33 and by toluene in Example 34. Each of these solvents was mixed with methyl alcohol, as the other solvent of the mixture solvent, in a mixing ratio listed in Table 7, so as to establish the azeotropic composition. Except for this, the subsequent steps were performed in the same manner as in Example 30, thereby forming undercoat layers and then photoconductors of the respective examples. The resultant photoconductors were each mounted to the image forming apparatus for evaluation of the characteristics of a produced image. The results are shown in Table 7.

EXAMPLES 35 TO 39

In these examples, the mixture solvents contained in coating fluids for undercoat layers corresponding to those of Examples 30 to 34 contained methyl alcohol and the other solvent in a mixing ratio of 41:41 (parts by weight), respectively. Except for this, the subsequent steps were performed in the same manner as in Example 30, thereby forming undercoat layers and then photoconductors of the respective examples. The resultant photoconductors were each mounted to the image forming apparatus for evaluation of the characteristics of a produced image. The results are shown in Table 7.

Comparative Example 27

In this comparative example, the mixture solvent of Example 30 was replaced by 82 parts by weight of single solvent of methyl alcohol. Except for this, the subsequent steps were performed in the same manner as in Example 30, thereby forming an undercoat layer and then a photoconductor. The resultant photocondutor was mounted to the image forming apparatus for evaluation of the characteristics of a produced image. The results are shown in Table 7.

EXAMPLES 40 TO 49

Undercoat layers and photoconductors of Examples 40 to 49 were formed in the same manner as in corresponding Examples 30 to 39, except for that the coating fluids of Examples 30 to 39, which had been left standing for 90 days, were used correspondingly. The resultant photoconductors were each mounted to the image forming apparatus for evaluation of the characteristics of a produced image. The results are shown in Table 8.

Comparative Example 28

An undercoat layer and a photoconductor of this comparative example was formed in the same manner as in Comparative Example 27, except for that the coating fluid for undercoat layer of Comparative Example 27, which had been left standing for 90 days, was used. The resultant photoconductor was mounted to the image forming apparatus for evaluation of the characteristics of a produced image. The results are shown in Table 8.

TABLE 7

| | Solvent of coating fluid for undercoat layer | | | | Inconsistent coating thickness of undercoat layer | | Image density inconsistencies | | |
|---|---|---|---|---|---|---|---|---|---|
| Photoconductor | Composition (parts by weight) | Composition (parts by weight) | Coating fluid for undercoat layer: Dispersibility | Coating fluid for undercoat layer: Pot-Life | Drip | Ring | Drip | Ring | Texture fineness |
| Ex. 30 | Methyl alcohol 28.70 | 1,2-dichloroethane 53.30 | ○ | Immediately after preparation 0 | ○ | ○ | ○ | ○ | ○ |
| Ex. 31 | Methyl alcohol 43.46 | 1,2-dichloropropane 38.54 | ○ | Immediately after preparation 0 | ○ | ○ | ○ | ○ | ○ |
| Ex. 32 | Methyl alcohol 10.33 | Chloroform 71.67 | ○ | Immediately after preparation 0 | ○ | ○ | ○ | ○ | ○ |
| Ex. 33 | Methyl alcohol 25.50 | Tetrahydrofuran 56.50 | ○ | Immediately after preparation 0 | ○ | ○ | ○ | ○ | ○ |
| Ex. 34 | Methyl alcohol 58.30 | Toluene 23.70 | ○ | Immediately after preparation 0 | ○ | ○ | ○ | ○ | ○ |
| Ex. 35 | Methyl alcohol 41 | 1,2-dichloroethane 41 | ○ | Immediately after preparation 0 | ○ | ○ | ○ | ○ | ○ |
| Ex. 36 | Methyl alcohol 41 | 1,2-dichloropropane 41 | ○ | Immediately after preparation 0 | ○ | ○ | ○ | ○ | ○ |
| Ex. 37 | Methyl alcohol 41 | Chloroform 47 | ○ | Immediately after preparation 0 | ○ | ○ | ○ | ○ | ○ |

TABLE 7-continued

| Photoconductor | Solvent of coating fluid for undercoat layer: Composition (parts by weight) | Solvent of coating fluid for undercoat layer: Composition (parts by weight) | Coating fluid for undercoat layer: Dispersibility | Coating fluid for undercoat layer: Pot-Life | Inconsistent coating thickness of undercoat layer: Drip | Inconsistent coating thickness of undercoat layer: Ring | Image density inconsistencies: Drip | Image density inconsistencies: Ring | Image density inconsistencies: Texture fineness |
|---|---|---|---|---|---|---|---|---|---|
| Ex. 38 | Methyl alcohol 41 | Tetrahydrofuran 41 | ○ | Immediately after preparation 0 | ○ | ○ | ○ | ○ | ○ |
| Ex. 39 | Methyl alcohol 41 | Toluene 41 | ○ | Immediately after preparation 0 | ○ | ○ | ○ | ○ | ○ |
| Comp. Ex. 27 | Methyl alcohol 82 | — | x | Immediately after preparation 0 | xx | x | x | x | xx |

Dispersibility evaluation
○ Excellent
Δ Acceptable
x Aggregation
Inconsistency evaluation
○ No inconsistency
Δ Acceptable
x Some inconsistencies
xx Serious inconsistencies

TABLE 8

| Photoconductor | Coating fluid for undercoat layer: Can-stability | Coating fluid for undercoat layer: Pot-Life | Inconsistent coating thicknesses of undercoat layer: Drip | Inconsistent coating thicknesses of undercoat layer: Ring | Image density inconsistencies: Drip | Image density inconsistencies: Ring | Image density inconsistencies: Texture fineness |
|---|---|---|---|---|---|---|---|
| Ex. 40 | ○ | 90 | ○ | ○ | ○ | ○ | ○ |
| Ex. 41 | ○ | 90 | ○ | ○ | ○ | ○ | ○ |
| Ex. 42 | ○ | 90 | ○ | ○ | ○ | ○ | ○ |
| Ex. 43 | ○ | 90 | ○ | ○ | ○ | ○ | ○ |
| Ex. 44 | ○ | 90 | ○ | ○ | ○ | ○ | ○ |
| Ex. 45 | ○ | 90 | ○ | ○ | ○ | ○ | ○ |
| Ex. 46 | ○ | 90 | ○ | ○ | ○ | ○ | ○ |
| Ex. 47 | ○ | 90 | ○ | ○ | ○ | ○ | ○ |
| Ex. 48 | ○ | 90 | ○ | ○ | ○ | ○ | ○ |
| Ex. 49 | ○ | 90 | ○ | ○ | ○ | ○ | ○ |
| Comp.Ex. 28 | x | 90 | xx | x | x | x | xx |

Can-stability evaluation
○ Excellent
Δ Acceptable
x Aggregation
Inconsistency evaluation
○ No inconsistency
Δ Acceptable
x Some inconsistencies
xx Serious inconsistencies According to the results of the evaluation of Examples 30 to 49 and of Comparative Examples 27 and 28, the coating fluid for undercoat layer, each including the needle-shaped particles of metal oxide surface-treated with the coupling agent with the unsaturated bond, the binder composed of as shown by Examples 30 to 49 polyamide and the mixture solvent of the azeotropic composition, accomplished improvement in dispersibility and can-stability from the dispersibility and can-stability of the coating fluids for undercoat layer each containing the solvent composed of a single component. Thus, such coating fluids allowed the undercoat layer free from inconsistent coating thicknesses to be formed in a stable manner. Furthermore, the use of the photoconductor including such an undercoat layer offered an image free from inconsistent image densities and with excellent image characteristics.

EXAMPLE 50

To a mixture solvent containing 28.7 parts by weight of methyl alcohol and 53.3 parts by weight of 1,2-dichloroethane, there were added 1.8 parts by weight of needle-shaped particles of titanium oxide (commercially available as STR-60N from Sakai Chemical Industry Co., Ltd. and having a long axis L of 0.05 μm, a short axis S of 0.01 μm and an aspect ratio of 5), 15.84 parts by weight of copolymer nylon resin (commercially available as CM8000 from Toray Industries, Inc.) as the binder and 0.36 parts by weight of methacryloxypropyl methoxysilane (commercially available as S710 from Chisso Corporation) as the coupling agent with the unsaturated bond. The resultant mixture solution was agitated for dispersion by the paint shaker for 8 hours thereby to prepare a coating fluid for undercoat layer. In this example, the coupling agent served as the dispersant in the coating fluid for undercoat layer. The resultant coating fluid for undercoat layer was used to form an undercoat layer and then a photocondutor in the same manner as in Example 30. The photoconductor was evaluated for the imaging characteristics thereof. Incidentally, a proportion of needle-shaped particles of titanium oxide relative to the total weight of the undercoat layer was 10 wt % while a proportion of coupling agent with the unsaturated bond relative to the weight of the titanium oxide was 20 wt %. The evaluation results are shown in Table 9.

EXAMPLES 51 AND 52

Undercoat layers and photoconductors of these examples were formed in the same manner as in Example 50, except for that a proportion of needle-shaped particles of titanium oxide relative to the total weight of the undercoat layer was 30 wt % in Example 51 and 50 wt % in Example 52. The resultant photoconductors were each evaluated for the imaging characteristics thereof. The results are shown in Table 9.

EXAMPLES 53 TO 55

Undercoat layers and photoconductors of these examples were formed in the same manner as in corresponding Examples 50 to 52, except for that the binder of the undercoat layer was replaced by N-methoxymethylated nylon resin (commercially available as EF-30T from Teikoku Chemical Industries Co., Ltd.). The resultant photoconductors were evaluated for the imaging characteristics thereof. The results are shown in Table 9.

Comparative Examples 29 to 31

Undercoat layers and photoconductors of these comparative examples were formed in the same manner as in corresponding Examples 50 to 52, except for that granular titanium oxide surface-treated with $AlO_3$ (commercially available as TTO-55A from Ishihara Kogyo Kaisha, Ltd. and having a mean particle size of 0.03 $\mu$m to 0.05 $\mu$m) was used as the titanium oxide and the coupling agent with the unsaturated bond was not used. The resultant photoconductors were evaluated for the imaging characteristics thereof, respectively. The results are shown in Table 9.

Comparative Examples 32 to 34

Undercoat layers and photoconcutors of these comparative examples were formed in the same manner as in corresponding Comparative Examples 29 to 31, except for that the binder of the undercoat layer was replaced by N-methoxymethylated nylon resin (commercially available as EF-30T from Teikoku Chemical Industries Co., Ltd.). The resultant photoconductors were evaluated for the imaging characteristics thereof, respectively. The results are shown in Table 9.

EXAMPLES 56 TO 58

Coating fluids for undercoat layer for these examples were prepared in the same manner as in corresponding Examples 50 to 52, except for that the mixture solvent contained 43.46 parts by weight of methyl alcohol and 38.54 parts by weight of 1,2-dichloropropane. The resultant coating fluids were used to form an undercoat layer and then a photoconductor, respectively. The resultant photoconductors were evaluated for the imaging characteristics thereof, respectively. The results are shown in Table 10.

EXAMPLES 59 TO 61

Coating fluids for undercoat layer of these examples were prepared in the same manner as in corresponding Examples 56 to 58, except for that the binder of the coating fluid was replaced by the N-methoxymethylated nylon resin (commercially available as EF-30T from Teikoku Chemical Industries Co., Ltd.). The resultant coating fluids for undercoat layer were used to form undercoat layers and photoconductors, respectively. The resultant photoconductors were evaluated for the imaging characteristics thereof, respectively. The results are shown in Table 10.

EXAMPLES 62 TO 64

Coating fluids for undercoat layer of these examples were prepared in the same manner as in Example 50, except for that each coating fluid contained 9 parts by weight of needle-shaped particles of titanium oxide and 9 parts by weight of binder while the mixture solvent of each coating fluid had an azeotropic composition such as 10.33 parts by weight of methyl alcohol in combination with 71.67 parts by weight of chloroform in Example 62, 25.50 parts by weight of methyl alcohol in combination with 56.50 parts by weight of tetrahydrofuran in Example 63, and 58.30 parts by weight of methyl alcohol in combination with 23.70 parts by weight of toluene in Example 64. The resultant coating fluids were used to form respective undercoat layer and then a photoconductor. The photoconductors were evaluated for the imaging characteristics thereof, respectively. The results are shown in Table 10.

TABLE 9

| | | | Solvent of coating fluid for undercoat layer | | Coating fluid for undercoat layer | | Inconsistent coating thickness of undercoat layer | | Image density inconsistencies | | |
|---|---|---|---|---|---|---|---|---|---|---|---|
| | $TiO_2$ | | Composition | Composition | | | | | | | Texture |
| Photoconductor | Type | Wt % | (parts by weight) | (parts by weight) | Coupling agent | Binder | Drip | Ring | Drip | Ring | fineness |
| Ex. 50 | A | 10 | Methylalcohol 28.70 | 1,2-dichloroethane 53.30 | Used | a | ○ | ○ | ○ | ○ | ○ |
| Ex. 51 | A | 30 | Methylalcohol 28.70 | 1,2-dichloroethane 53.30 | Used | a | ○ | ○ | ○ | ○ | ○ |
| Ex. 52 | A | 50 | Methylalcohol 28.70 | 1,2-dichloroethane 53.30 | Used | a | ○ | ○ | ○ | ○ | ○ |
| Ex. 53 | A | 10 | Methylalcohol 28.70 | 1,2-dichloroethane 53.30 | Used | b | ○ | ○ | ○ | ○ | ○ |
| Ex. 54 | A | 30 | Methylalcohol 28.70 | 1,2-dichloroethane 53.30 | Used | b | ○ | ○ | ○ | ○ | ○ |
| Ex. 55 | A | 50 | Methylalcohol 28.70 | 1,2-dichloroethane 53.30 | Used | b | ○ | ○ | ○ | ○ | ○ |
| Comp.Ex. 29 | B | 10 | Methylalcohol 28.70 | 1,2-dichloroethane 53.30 | Not used | a | x | Δ | x | Δ | x |
| Comp.Ex. 30 | B | 30 | Methylalcohol 28.70 | 1,2-dichloroethane 53.30 | Not used | a | x | x | x | x | x |
| Comp.Ex. 31 | B | 50 | Methylalcohol 28.70 | 1,2-dichloroethane 53.30 | Not used | a | x | x | x | x | x |
| Comp.Ex. 32 | B | 10 | Methylalcohol 28.70 | 1,2-dichloroethane 53.30 | Not used | b | x | Δ | x | Δ | x |
| Comp.Ex. 33 | B | 30 | Methylalcohol 28.70 | 1,2-dichloroethane 53.30 | Not used | b | x | x | x | x | x |

TABLE 9-continued

| Photoconductor | $TiO_2$ Type | $TiO_2$ Wt % | Solvent of coating fluid for undercoat layer: Composition (parts by weight) | Solvent of coating fluid for undercoat layer: Composition (parts by weight) | Coating fluid for undercoat layer: Coupling agent | Coating fluid for undercoat layer: Binder | Inconsistent coating thickness of undercoat layer: Drip | Inconsistent coating thickness of undercoat layer: Ring | Image density inconsistencies: Drip | Image density inconsistencies: Ring | Texture fineness |
|---|---|---|---|---|---|---|---|---|---|---|---|
| Comp.Ex. 34 | B | 50 | Methylalcohol 28.70 | 1,2-dichloroethane 53.30 | Not used | b | x | x | x | x | x |

$TiO_2$
A: STR-60N. needle-shaped particles not surface-treated, available from Sakai C.I.C.L.
B: TTO-55A, granules surface-treated with $Al_2O_3$, available from Ishihara S.K.L.
Binder
a: copolymer nylon resin CM-8000, available from Toray I.I.
b: N-methoxymethylated nylon EF-30T, available from Teikoku C.I.C.L.,
Coupling agent methacryloxypropyl trimethoxysilane, available from Chisso C.
Inconsistency evaluation:
○ Excellent
Δ Acceptable
x Inconsistencies

TABLE 10

| Photoconductor | $TiO_2$ Type | $TiO_2$ Wt % | Solvent of coating fluid for undercoat layer: Composition (parts by weight) | Solvent of coating fluid for undercoat layer: Composition (parts by weight) | Coating fluid for undercoat layer: Coupling agent | Coating fluid for undercoat layer: Binder | Inconsistent coating thickness of undercoat layer: Drip | Inconsistent coating thickness of undercoat layer: Ring | Image density inconsistencies: Drip | Image density inconsistencies: Ring | Texture fineness |
|---|---|---|---|---|---|---|---|---|---|---|---|
| Ex. 56 | A | 10 | Methylalcohol 43.46 | 1,2-dichloropropane 38.54 | Used | a | ○ | ○ | ○ | ○ | ○ |
| Ex. 57 | A | 30 | Methylalcohol 43.56 | 1,2-dichloropropane 38.54 | Used | a | ○ | ○ | ○ | ○ | ○ |
| Ex. 58 | A | 50 | Methylalcohol 43.46 | 1,2-dichloropropane 38.54 | Used | a | ○ | ○ | ○ | ○ | ○ |
| Ex. 59 | A | 10 | Methylalcohol 43.46 | 1,2-dichloropropane 38.54 | Used | b | ○ | ○ | ○ | ○ | ○ |
| Ex. 60 | A | 30 | Methylalcohol 43.46 | 1,2-dichloropropane 38.54 | Used | b | ○ | ○ | ○ | ○ | ○ |
| Ex. 61 | A | 50 | Methylalcohol 43.46 | 1,2-dichloropropane 38.54 | Used | b | ○ | ○ | ○ | ○ | ○ |
| Ex. 62 | A | 50 | Methylalcohol 10.33 | Chloroform 71.67 | Used | a | ○ | ○ | ○ | ○ | ○ |
| Ex. 63 | A | 50 | Methylalcohol 56.50 | Tetrahydrofuran 56.50 | Used | a | ○ | ○ | ○ | ○ | ○ |
| Ex. 64 | A | 50 | Methylalcohol 58.30 | Toluene 23.70 | Used | a | ○ | ○ | ○ | ○ | ○ |

$TiO_2$
A: STR-60N. needle-shaped particles not surface-treated, available from Sakai C.I.C.L.
Binder
a: copolymer nylon resin CM-8000, available from Toray I.I.
b: N-methoxymethylated nylon EF-30T, available from Teikoku C.I.C.L.,
Coupling agent methacryloxypropyl trimethoxysilane, available from Chisso C.
Inconsistency evaluation:
○ Excellent
Δ Acceptable
x Inconsistencies According to the results of the evaluation of Examples 50 to 64 and of Comparative Examples 29 to 34, by virtue of the coupling agent serving as the dispersant, the coating fluids, each containing the coupling agent with the unsaturated bond, the needle-shaped particles of metal oxide, the binder composed of polyamide and the mixture solvent of the azeotropic composition, provided the undercoat layers free from inconsistent coating thicknesses, in contrast to the coating fluids for undercoat layer, each containing the metal oxide surface-treated for conductivity impartation. When an image is formed by the use of the photoconductor having such an undercoat layer, an image free from inconsistent image densities and with excellent image characteristics was obtained.

EXAMPLE 65

The photoconductor of Example 30 was subject to evaluation of the imaging characteristics thereof under the L/L environment and the H/H environment. The evaluation of the imaging characteristics was carried out by mounting the photoconductor to the image forming apparatus (commercially available as SF-8870 from Sharp Corporation). There were obtained excellent images free from inconsistent image densities, the inconsistent image densities attributable to surface flaws of the substrate or inconsistent thicknesses of the undercoat layer. Additionally, even after 20,000 times of use of the photoconductor, there were obtained images substantially as excellent as those produced by the use of a fresh photoconductor.

Comparative Example 35

A photoconductor was produced in the same manner as in Example 30, except for that the undercoat layer was not formed. Similarly to Example 65, the resultant photoconductor was evaluated for the imaging characteristics thereof under the L/L environment and the H/H environment. There were observed the inconsistencies in image densities in the resultant images, which inconsistencies were caused by the surface flows of the substrate or inconsistent thicknesses of the undercoat layer. In addition, a lowered photosensitivity of the photoconductor resulted in the occurrence of fogs in a white area of the image. After repeated use of the photoconductor, the degradation of the imaging characteristics of the photoconductor was further increased.

EXAMPLE 66

In this example, a single-layered type photoconductor shown in FIG. 1B was produced. A coating fluid for undercoat layer was prepared in the same manner as in Example 23, except for that methacryloxypropyl trimethoxysilane (commercially available as S710 from Chisso Corporation) was used as the coupling agent with the unsaturated bond. An undercoat layer was formed on the substrate in the same manner as in Example 30, which used the dip coating method.

Next, 17.1 parts by weight of perylene pigment represented by the following chemical formula 3 and 17.1 parts by weight of polycarbonate (commercially available as Z-400 from Mitsubishi Gas Chemical Co., Ltd) were dissolved in 66.8 parts by weight of tetrahydrofuran. The resultant mixture solution was agitated for dispersion by the paint shaker for 12 hours. Subsequently, 17.1 parts by weight of diphenoquinone compound represented by the following chemical formula 4 and 100 parts by weight of tetrahydrofuran were added to the mixture solution, which was further agitated for dispersion for 2 hours. Thus was prepared a coating fluid for photosensitive layer. The resultant coating fluid for photosensitive layer was applied to the undercoat layer by means of the dip coating method and was subject to the hot-air drying process at 100° C. for 1 hour. Thus was formed a photosensitive layer having a thickness of 15 μm in dry state. The single-layered type photoconductor thus produced was subject to the evaluation of the imaging characteristics thereof in the same manner as in Example 30. There were obtained excellent images free from inconsistent image densities caused by the surface flaws of the substrate or inconsistent thicknesses of the undercoat layer.

[Chemical Formula 3]

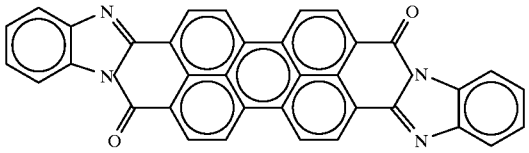

[Chemical Formula 4]

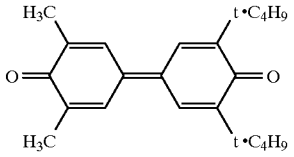

The invention may be embodied in other specific forms without departing from the spirit or essential characteristics thereof. The present embodiments are therefore to be considered in all respects as illustrative and not restrictive, the scope of the invention being indicated by the appended claims rather than be the foregoing description and all changes which come within the meaning and the range of equivalency of the claims are therefore intended to be embraced therein.

What is claimed is:

1. An electrophotographic photoconductor comprising:

a conductive substrate;

an undercoat layer formed on the substrate; and a photosensitive layer formed on the undercoat layer, wherein the undercoat layer includes a coupling agent having an unsaturated bond, a binder and particles of titanium oxide having a needle-like particulate shape and surface treated with the coupling agent.

2. The electrophotographic photoconductor of claim 1, wherein the coupling agent is a sililation agent having an unsaturated bond.

3. The electrophotographic photoconductor of claim 1, wherein the coupling agent is a silane coupling agent having an unsaturated bond.

4. The electrophotographic photoconductor of claim 1, wherein the metal oxide is preliminarily surface-treated with the coupling agent.

5. The electrophotographic photoconductor of claim 1, wherein the needle-like titanium oxide particles have a short axis selected from a range of between 0.001 μm and 1 μm, a long axis selected from a range of between 0.002 μm and 100 μm, and a mean value of an aspect ratio selected from a range of between 1.5 and 300.

6. The electrophotographic photoconductor of claim 1, wherein a proportion of the titanium oxide particles relative to the total weight of the undercoat layer is selected from a range of between 10 wt % and 99 wt %.

7. The electrophotographic photoconductor of claim 1, wherein the binder comprises a polyamide resin soluble in an organic solvent.

8. The electrophotographic photoconductor of claim 1, wherein the titanium oxide not subject to a surface-treatment for conductivity impartation.

9. A method of producing an electrophotographic photoconductor, which includes a conductive substrate, an undercoat layer formed on the substrate and a photosensitive layer formed on the undercoat layer, wherein the undercoat layer is formed by the use of a coating fluid for undercoat layer which contains a coupling agent having an unsaturated bond, particles of titanium oxide having a needle-like particulate shape and surface treated with the coupling agent, a binder and a solvent.

10. The method of producing an electrophotographic photoconductor of claim 9, wherein the solvent is a mixture solvent containing a solvent selected from the group consisting of lower alcohols having 1 to 4 carbon atoms and a solvent selected from the group consisting of dichloromethane, chloroform, 1,2-dichloroethane, 1,2-dichloropropane, toluene, and tetrahydrofran, and the binder is a polyamide resin soluble in the mixture solvent.

11. The method of producing an electrophotographic photoconductor of claim 9, wherein the coupling agent serves as a dispersant in the coating fluid for undercoat layer, the solvent is a mixture solvent containing a solvent selected from the group consisting of lower alcohols having 1 to 4 carbon atoms and a solvent selected from the group consisting of dichloromethane, chloroform, 1,2-dichloroethane, 1,2-dichloropropane, toluene, and tetrahydrofran, and the binder is a polyamide resin soluble in the mixture solvent.

12. An electrophotographic photoconductor comprising:

a conductive substrate;

an undercoat layer formed on the substrate; and a photosensitive layer formed on the undercoat layer, wherein the undercoat layer includes a silane coupling agent having an unsaturated bond, a binder and particles of titanium oxide having a needle-like particulate shape and surface treated with the coupling agent forming 10 to 99% by weight of the undercoat layer.

13. A method of producing an electrophotographic photoconductor, which includes a conductive substrate, an undercoat layer formed on the substrate and a photosensitive layer formed on the undercoat layer, wherein the undercoat layer is formed by the use of a coating fluid for undercoat layer which contains a silane coupling agent having an unsaturated bond, particles of titanium oxide having a needle-like particulate shape and surface treated with the coupling agent, a binder and a solvent in which the titanium oxide particles form 10 wt % to 90 wt % of the undercoat layer.

* * * * *